US007798617B2

(12) United States Patent
Ito et al.

(10) Patent No.: US 7,798,617 B2
(45) Date of Patent: Sep. 21, 2010

(54) INKJET RECORDING APPARATUS, MANUFACTURING METHOD OF INKJET HEAD, AND CHECKING METHOD OF THE HEAD

(75) Inventors: Koji Ito, Gifu (JP); Yuji Miwa, Chita (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 422 days.

(21) Appl. No.: 12/026,517

(22) Filed: Feb. 5, 2008

(65) Prior Publication Data

US 2008/0186342 A1 Aug. 7, 2008

(30) Foreign Application Priority Data

Feb. 5, 2007 (JP) ..... 2007-026022
Feb. 5, 2007 (JP) ..... 2007-026023

(51) Int. Cl.
*B41J 2/045* (2006.01)

(52) U.S. Cl. ..... 347/71

(58) Field of Classification Search ..... 347/71, 347/70, 72, 68–69, 57–58, 50, 17

See application file for complete search history.

(56) References Cited

U.S. PATENT DOCUMENTS 7,571,993 B2 * 8/2009 Ito ..... 347/71
7,585,062 B2 * 9/2009 Momose ..... 347/71
7,654,653 B2 * 2/2010 Ito ..... 347/71

FOREIGN PATENT DOCUMENTS

JP 2002036568 A 2/2002

* cited by examiner

*Primary Examiner*—K. Feggins
(74) *Attorney, Agent, or Firm*—Baker Botts, LLP.

(57) ABSTRACT

An inkjet recording apparatus includes a passage unit in which individual ink passages are formed, an actuator unit fixed to the passage unit, a flat flexible substrate, and a drive signal outputting unit. The actuator unit includes individual electrodes, a common electrode, a piezoelectric layer, and individual lands. The flat flexible substrate includes output terminals connected to the respective individual lands, and a check terminal bonded to a bonding face of the actuator unit. The drive signal outputting unit outputs drive signals to be supplied to the individual electrodes via the respective output terminals. Based on a measurement result of an electrical characteristic with respect to the check terminal, it is judged whether the check terminal has been peeled off from the bonding face of the actuator unit.

20 Claims, 28 Drawing Sheets

INKJET RECORDING APPARATUS, MANUFACTURING METHOD OF INKJET HEAD, AND CHECKING METHOD OF THE HEAD

The present application claims priority from Japanese Patent Applications No. 2007-26022 and No. 2007-26023, which were both filed on Feb. 5, 2007, the disclosures of which are herein incorporated by reference in their entirety.

BACKGROUND OF THE INVENTION

1. Field of the Invention

The present invention relates to an inkjet recording apparatus in which ink droplets are ejected to print, a manufacturing method of an inkjet head, and a checking method of the head.

2. Description of Related Art

An inkjet head which ejects ink droplets onto a recording medium such as a printing paper includes a passage unit having nozzles to eject ink droplets and individual ink passages including pressure chambers connected to the respective nozzles; and a piezoelectric actuator, that is, an actuator unit, for giving ejection energy to ink in each pressure chamber. The piezoelectric actuator changes the volume of the pressure chamber to give pressure in the pressure chamber. Japanese Patent Unexamined Publication No. 2002-36568 discloses a piezoelectric actuator including a piezoelectric sheet positioned over a number of pressure chambers; a number of individual electrodes positioned on a surface of the piezoelectric sheet so as to be opposed to the respective pressure chambers; and a common electrode positioned so as to be opposed to the individual electrodes through the piezoelectric sheet. Connection lands, that is, individual lands, electrically connected to the respective individual electrodes are positioned on a surface of the piezoelectric actuator. Each connection land is bonded to one of terminals positioned near one end of a flat cable as a flat flexible substrate. Each terminal is connected, via a wire formed on the flat cable, to a wire on a higher-rank control substrate. The flat cable supplies drive signals to the respective individual electrodes via the terminals. When a drive signal as a pulse train signal is supplied to an individual electrode via the flat cable, an electric field is generated at the portion of the piezoelectric sheet sandwiched by the individual electrode and the common electrode, along the thickness of the sheet. Thus, the thickness of the portion of the piezoelectric sheet increases. Thereby, the corresponding pressure chamber is changed in its volume to give pressure to ink in the pressure chamber.

SUMMARY OF THE INVENTION

A manner of setting the flat cable may bring about stress on the boding interface between a terminal provided on the flat cable and a connection land provided on the piezoelectric actuator. The stress may cause peeling of the terminal from the connection land.

In particular, when the flat cable is bent at a right angle relatively to the bonding interface, the terminal nearest to the bent portion is apt to peel off from the corresponding connection land provided on the piezoelectric actuator. That is, the flat cable is apt to separate from the piezoelectric actuator. It is difficult to visually check the bonding quality between the terminals provided on the flat cable and the connection lands provided on the piezoelectric actuator. By actually driving the inkjet head to eject ink droplets from all nozzles, it can be checked whether or not electrical connections between the terminals and the connection lands are good. However, this checking method is troublesome. In addition, because of a checking method in which ink is actually supplied to the inkjet head, the inkjet head is hard to mend even when defect in electrical connection has been found out in the inkjet head.

On the other hand, bonding defect between a terminal provided on the flat cable and a connection land provided on the piezoelectric actuator causes a reduction in the yield of inkjet heads. In manufacturing and checking inkjet heads, therefore, the bonding conditions between the terminals provided on the flat cable and the connection lands provided on the piezoelectric actuator, including heating temperature, heating time, and pressing force in bonding, must be controlled so that the terminals and the connection lands are surely bonded to each other. For controlling the bonding conditions, the manufacturer must have grasped the degree of separation of the flat cable from the piezoelectric actuator under the boding conditions actually practiced. However, the degree of separation is difficult to visually check.

An object of the present invention is to provide an inkjet recording apparatus in which separation of a flat flexible substrate from an actuator unit can easily be found out.

Another object of the present invention is to provide a manufacturing method of an inkjet head, a checking method of the head, and an inkjet recording apparatus, wherein the manufacturer or a user can easily grasp the degree of separation of a flat flexible substrate from an actuator unit.

According to an aspect of the present invention, an inkjet recording apparatus comprises a passage unit in which formed are a plurality of individual ink passages each leading to a nozzle via a pressure chamber; and an actuator unit fixed to the passage unit. The actuator unit comprises a plurality of individual electrodes related to the respective pressure chambers, a common electrode, a piezoelectric layer interposed between the plurality of individual electrodes and the common electrode, and a plurality of individual lands positioned on a bonding face of the actuator unit opposite from a fixing face of the actuator unit fixed to the passage unit, the plurality of individual lands being electrically connected to the respective individual electrodes. The apparatus further comprises a flat flexible substrate comprising a plurality of output terminals bonded to the respective individual lands, and a check terminal bonded to the bonding face of the actuator unit; a drive signal outputting unit which outputs drive signals to be supplied to the plurality of individual electrodes via the plurality of output terminals; a measuring unit which measures an electrical characteristic with respect to the check terminal; and a judging unit which judges, on the basis of a measurement result of the measuring unit, whether or not the check terminal has separated from the bonding face of the actuator unit.

According to the invention, by a simple method of measuring an electrical characteristic with respect to the check terminal, it can be judged whether or not the check terminal has been peeled off from the bonding face of the actuator unit. Therefore, in the manufacturing process of the inkjet head, separation of the flat flexible substrate from the actuator unit can easily be found out. In addition, even when the flat flexible substrate is separated from the actuator unit after shipping the inkjet head, the separation can easily be found out. In this specification, "separation of the flat flexible substrate from the actuator unit" means that one or more individual lands have been peeled off from the respectively corresponding output terminals.

According to another aspect of the present invention, a manufacturing method of an inkjet head comprises a fixing step of fixing an actuator unit comprising a plurality of individual electrodes, a common electrode, a piezoelectric layer interposed between the plurality of individual electrodes and the common electrode, and a plurality of individual lands electrically connected to the respective individual electrodes, to a passage unit in which formed are a plurality of individual ink passages each leading to a nozzle via a pressure chamber, so that the plurality of individual electrodes are opposed to the respective pressure chambers; a bonding step of bonding to the actuator unit a flat flexible substrate comprising a plurality of output terminals and a plurality of check terminals, so that the plurality of check terminals are bonded to a bonding face of the actuator unit opposite from a fixing face of the actuator unit fixed to the passage unit, and the plurality of individual lands are bonded to the respective output terminals; a measuring step of measuring an electrical characteristic with respect to the plurality of check terminals bonded to the bonding face of the actuator unit; and a judging step of deciding, on the basis of a measurement result in the measuring step, the number of check terminals having been peeled off from the bonding face of the actuator unit.

According to still another aspect of the present invention, a checking method of an inkjet head is provided. The head comprises a passage unit in which formed are a plurality of individual ink passages each leading to a nozzle via a pressure chamber; and an actuator unit fixed to the passage unit. The actuator unit comprises a plurality of individual electrodes related to the respective pressure chambers, a common electrode, a piezoelectric layer interposed between the plurality of individual electrodes and the common electrode, and a plurality of individual lands positioned on a bonding face of the actuator unit opposite from a fixing face of the actuator unit fixed to the passage unit, the plurality of individual lands being electrically connected to the respective individual electrodes. The head further comprises a flat flexible substrate comprising a plurality of output terminals bonded to the respective individual lands, and a plurality of check terminals bonded to the bonding face of the actuator unit. The method comprises a measuring step of measuring an electrical characteristic with respect to the plurality of check terminals; and a judging step of deciding, on the basis of a measurement result in the measuring step, the number of check terminals having been peeled off from the bonding face of the actuator unit.

According to still another aspect of the present invention, an inkjet recording apparatus comprises a passage unit in which formed are a plurality of individual ink passages each leading to a nozzle via a pressure chamber; and an actuator unit fixed to the passage unit. The actuator unit comprises a plurality of individual electrodes related to the respective pressure chambers, a common electrode, a piezoelectric layer interposed between the plurality of individual electrodes and the common electrode, and a plurality of individual lands positioned on a bonding face of the actuator unit opposite from a fixing face of the actuator unit fixed to the passage unit, the plurality of individual lands being electrically connected to the respective individual electrodes. The apparatus further comprises a flat flexible substrate comprising a plurality of output terminals bonded to the respective individual lands, and a plurality of check terminals bonded to the bonding face of the actuator unit; a measuring unit which measures an electrical characteristic with respect to the plurality of check terminals; and a judging unit which decides, on the basis of a measurement result of the measuring unit, the number of check terminals having been peeled off from the bonding face of the actuator unit.

According to the invention, by checking the number of check terminals having been peeled off from the bonding face of the actuator unit, the manufacturer can easily grasp the degree of separation of the flat flexible substrate from the actuator unit. This makes it easy to control the bonding conditions in the bonding step. This improves the yield of inkjet heads. In addition, the manufacturer or a user can easily judge whether or not there is possibility that the flat flexible substrate is separated from the actuator unit to lead to a trouble.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

Figure 1:
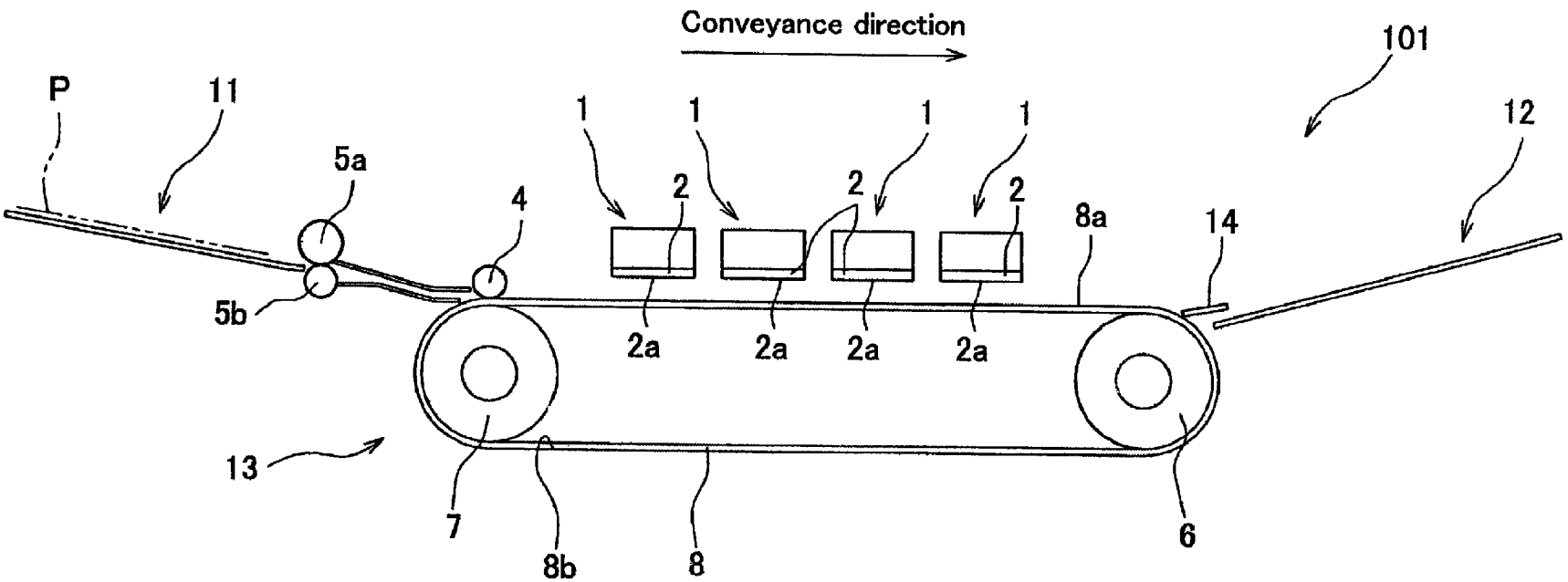
FIG. 1 is a side view of a principal part of an inkjet printer according to a first embodiment of the present invention.

FIG. 1 shows an inkjet printer 101 according to a first embodiment of the present invention. The inkjet printer 101 is a color inkjet printer having four inkjet heads 1 for respectively ejecting four different color inks of yellow, magenta, cyan, and black. The inkjet printer 101 includes a paper feed tray 11 in a left region in FIG. 1 and a paper discharge tray 12 in a right region in FIG. 1.

In the inkjet printer 101 formed is a conveyance path in which a paper P as a recording medium is conveyed from the paper feed tray 11 toward the paper discharge tray 12. At a position immediately downstream of the paper feed tray 11, a pair of feed rollers 5*a* and 5*b* are disposed for pinching the paper to convey. The pair of feed rollers 5*a* and 5*b* takes the paper P out of the paper feed tray 11 and sends the paper P rightward in FIG. 1. In the middle of the conveyance path, a belt conveyor mechanism 13 is provided that includes two belt rollers 6 and 7; an endless conveyor belt 8 wrapped on the rollers 6 and 7 to be stretched between the rollers; and a platen 15 disposed in the region surrounded by the conveyor belt 8 so as to be opposed to the inkjet heads 1. The platen 15 supports a portion of the conveyor belt 8 being opposed to the inkjet heads 1 so that the portion of the belt does not bend downward. A nip roller 4 is disposed so as to be opposed to the belt roller 7. The nip roller 7 presses onto the outer surface of the conveyor belt 8 the paper P sent from the paper feed tray 11 by the feed rollers 5*a* and 5*b*.

A not-shown conveyance motor drives the belt roller 6 to rotate, and thereby the conveyor belt 8 is run. The conveyor belt 8 carries the paper P pressed onto the outer surface of the belt by the nip roller 4 and adhering to the outer surface of the belt, and in this state, the belt 8 conveys the paper P toward the paper discharge tray 12.

A peeling plate 14 is provided immediately downstream of the conveyor belt 8 in the conveyance path. The peeling plate 14 peels off from the outer surface of the conveyor belt 8 the paper P adhering to the outer surface of the belt.

Four inkjet heads 1 are arranged in the conveyance direction of the paper P, and fixed so as to face the conveyance path. That is, the inkjet printer 101 is a line type printer. Each inkjet head 1 has at its lower end a head main body 2. The head main body 2 has a rectangular parallelepiped shape extending perpendicularly to the conveyance path. The bottom face of the head main body 2 is formed into an ink ejection face 2*a* facing a conveyance surface 8*a* that is an upper part of the outer surface of the conveyor belt 8. While the paper P being conveyed by the conveyor belt 8 sequentially passes just below the four head main bodies 2, the ink ejection faces 2*a* eject ink droplets of respective colors toward the upper surface of the paper P, that is, the print surface. Thus, a desired color image is formed on the paper P.

Figure 2:
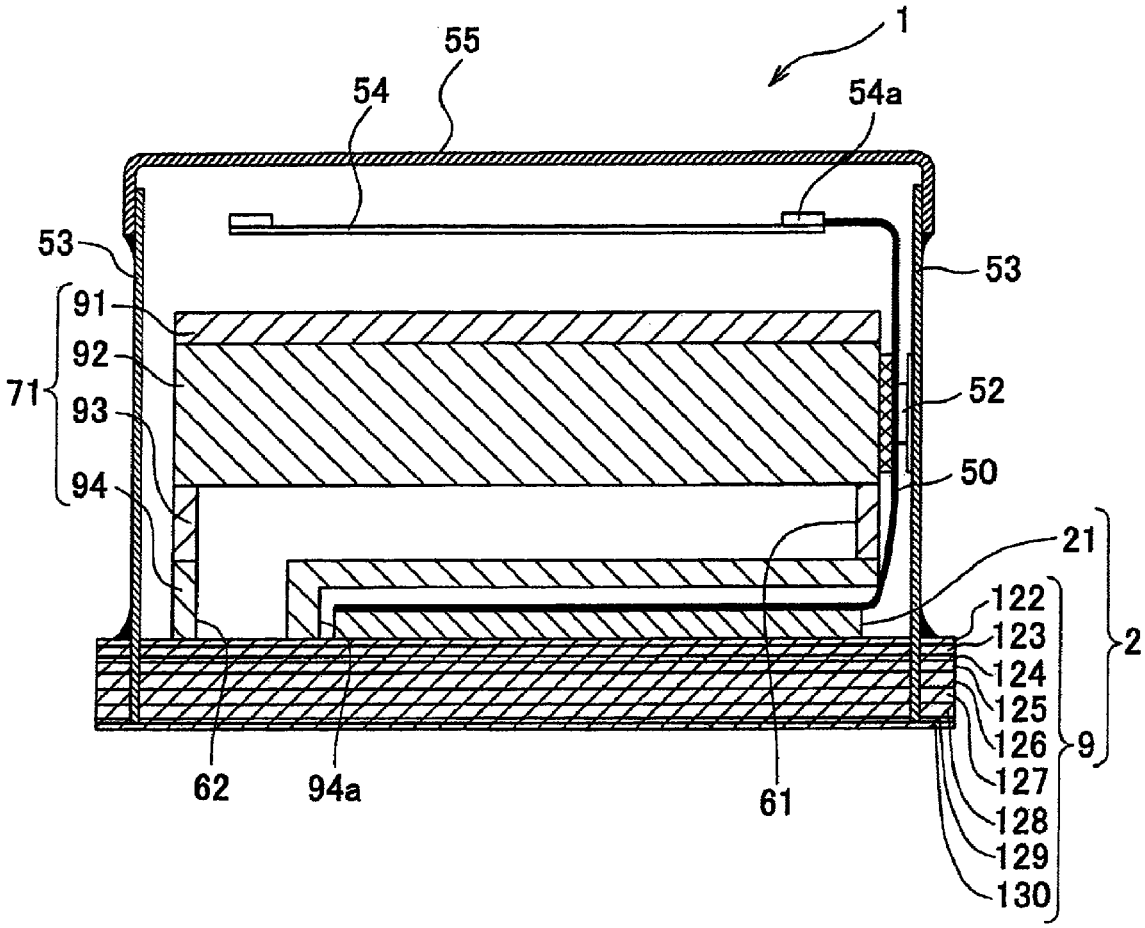
FIG. 2 is a lateral sectional view of an inkjet head shown in FIG. 1.

Next, each inkjet head 1 will be described in detail with reference to FIG. 2. As shown in FIG. 2, the inkjet head 1 includes a head main body 2 including a passage unit 9 and actuator units 21; a reservoir unit 71 positioned on the upper face of the head main body 2 for supplying ink into the head main body 2; chip-on films (COFs) 50 as flat flexible substrates on each of which a driver IC 52 is formed for generating a pulse train signal as a drive signal to drive the corresponding actuator unit 21; a control substrate 54 electrically connected to the COFs 50; and a side cover 53 and a head cover 55 that cover the actuator units 21, the reservoir unit 71, the COFs 50, and the control substrate 54 so as to prevent external ink mist from entering.

Figure 3:
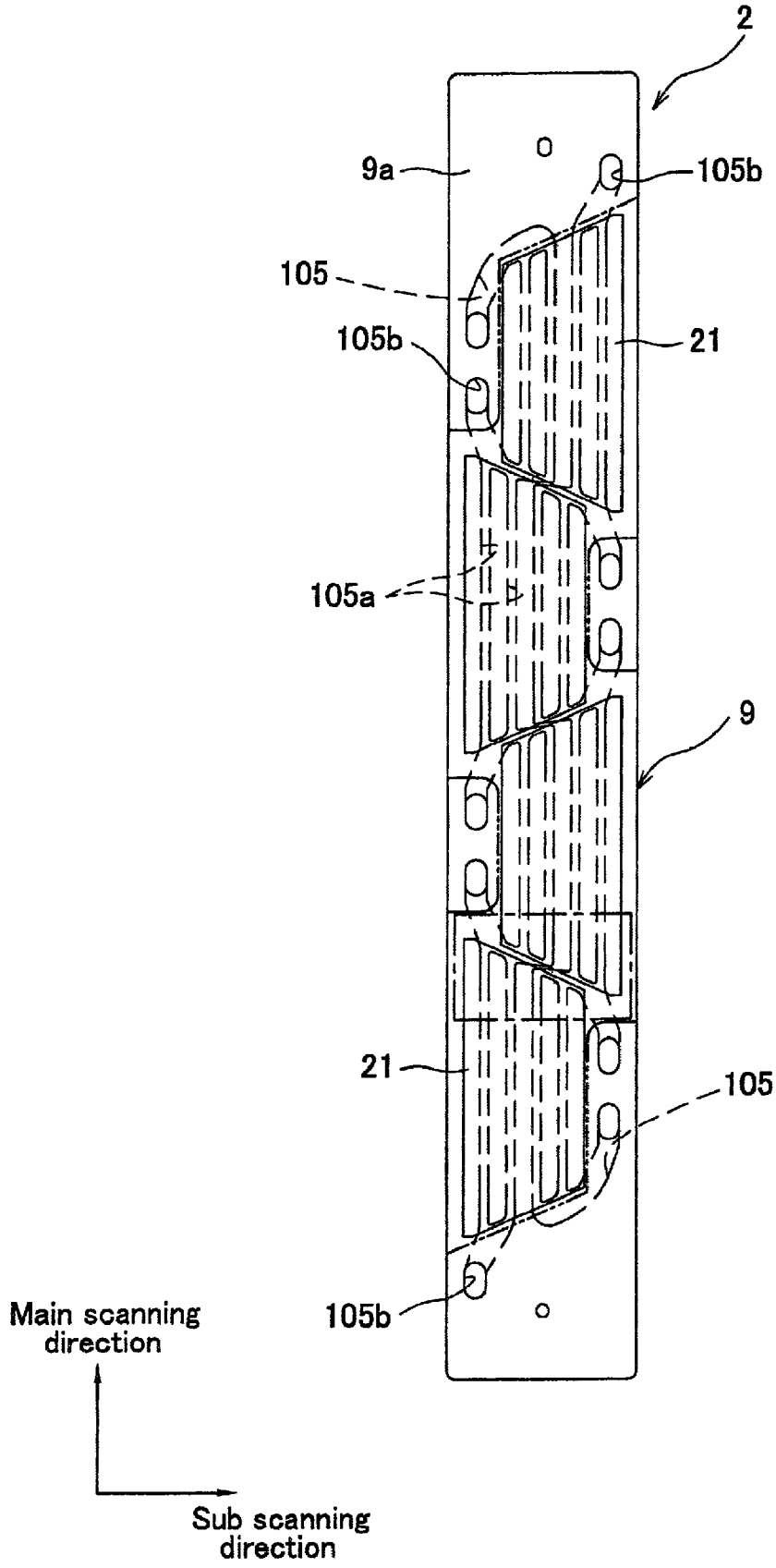
FIG. 3 is a plan view of a head main body shown in FIG. 2.

The reservoir unit 71 has a layered structure constituted by four plates 91 to 94. In the reservoir unit 71 formed are a not-shown ink flow-in passage, an ink reservoir 61, and ten ink flow-out passages 62 though FIG. 2 shows only one ink flow-out passage 62. The ink flow-in passage, the ink reservoir 61, and the ink flow-out passages 62 are connected to each other. Ink stored in the ink reservoir 61 flows through the respective ink flow-out passages 62, and then the ink is supplied into the passage unit 9 via ink supply ports 105*b* as shown in FIG. 3. The plate 94 has a plurality of protrusions 94*a* in which the ink flow-out passages 62 are formed. The protrusions 94*a* of the plate 94 form a space between the plate 94 and the passage unit 9. Four actuator units 21 are positioned in the space though FIG. 2 shows only one actuator unit 21.

A number of wires are formed on each COF 50 though they are not shown in FIG. 2. One ends of the wires are electrically connected to individual electrodes 135 and a common electrode 134 on a bonding face as the upper face of the corresponding actuator unit 21, which electrodes will be described later. The COF 50 extends upward between the side cover 53 and the reservoir unit 71. That is, the COF 50 is bent upward at a right angle near the right end of the actuator unit 21. As a result, stress in the direction in which the COF 50 is separated from the actuator unit 21 is intensively applied to a region of the bonding interface between the actuator unit 21 and the COF 50 relatively close to the bent portion of the COF 50. The other ends of the wires formed on the COF 50 are connected to electric components on the control substrate 54 via a connector 54*a*. The control substrate 54 outputs to each driver IC 52 a control signal supplied from a not-shown higher-rank controller.

The control substrate 54 controls the drive of each actuator unit 21 via the corresponding driver IC 52. Each driver IC 52 generates a drive signal to drive the corresponding actuator unit 21.

Next, each head main body 2 will be described. As shown in FIG. 3, each head main body 2 includes a passage unit 9 and four actuator units 21 fixed to the upper face 9*a* of the passage unit 9.

Figure 4:
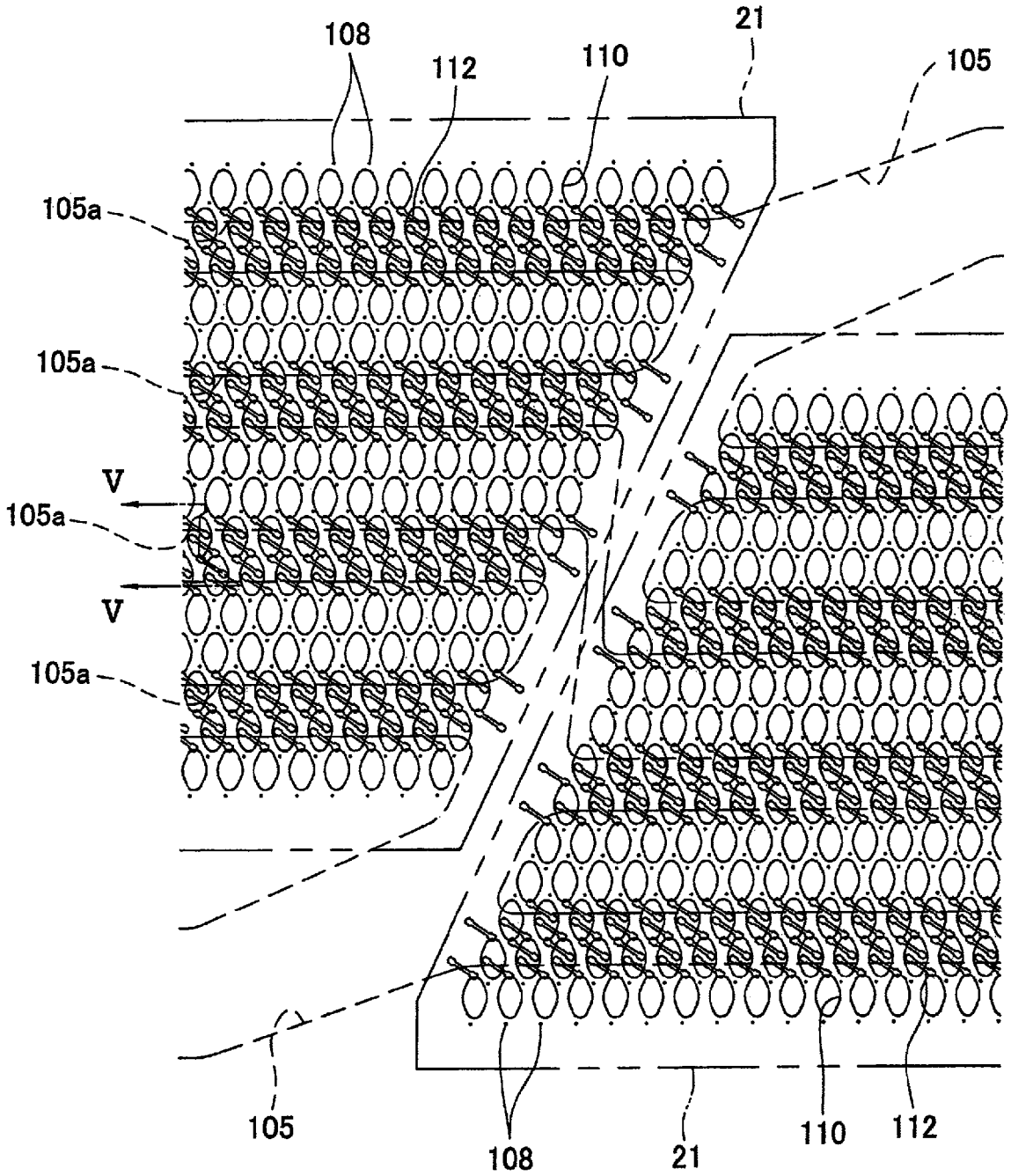
FIG. 4 is an enlarged view of a region enclosed with an alternate long and short dash line in FIG. 3.
Figure 5:
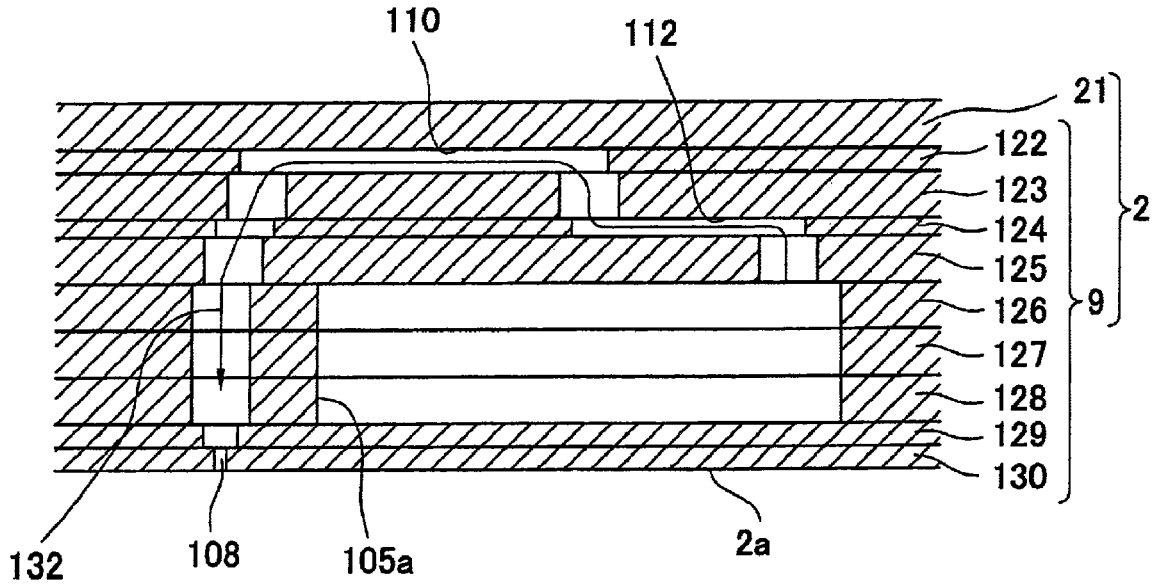
FIG. 5 is a sectional view taken along line V-V in FIG. 4.

The passage unit 9 has substantially the same rectangular parallelepiped shape in a plan view as the plate 94 of the reservoir unit 71. Ten ink supply ports 105*b* in total are open at the upper face 9*a* of the passage unit 9 so as to correspond to the respective ink flow-out passages 62 of the reservoir unit 71. In the passage unit 9, as shown in FIGS. 3 and 4, there are formed manifold channels 105 connected to the respective ink supply ports 105*b*; and sub manifold channels 105*a* as common ink chambers branched from each manifold channel 105. In FIG. 4, pressure chambers 110, apertures 112, and nozzles 108 are shown by solid lines though they should be shown by broken lines because they are behind the corresponding actuator units 21. As shown in FIGS. 4 and 5, the lower face of the passage unit 9 is formed into an ejection face 2*a* on which a plurality of nozzles 108 are arranged in a matrix. When viewing thorough the face of the passage unit 9 to which each actuator unit 21 is bonded, a plurality of pressure chambers 110 are arranged in a matrix similarly to the nozzles 108.

In this embodiment, sixteen rows of pressure chambers 110 each extending longitudinally of the passage unit 9 are arranged laterally parallel to each other at regular intervals. In each actuator unit 21, the number of pressure chambers 110 belonging to each row gradually decreases from the long side toward the short side of the actuator unit 21 in accordance with the trapezoidal profile of the actuator unit 21. The same applies to the nozzles 108.

As shown in FIG. 5, the passage unit 9 is made up of nine metal plates of, in the order from the upper side, a cavity plate 122, a base plate 123, an aperture plate 124, a supply plate 125, three manifold plates 126, 127, and 128, a cover plate 129, and a nozzle plate 130. Each of the plates 122 to 130 has a rectangular shape in a plan view extending in a main scanning direction. The plates 122 to 130 are put in layers after being positioned to each other. Thereby, manifold channels 105, sub manifold channels 105*a*, and a plurality of individual ink passages 132 each leading from the outlet of a sub manifold channel 105*a* via a pressure chamber 110 to a nozzle 108 are formed in the passage unit 9.

Flow of ink in the passage unit 9 will be described. Ink supplied from the reservoir unit 71 through each ink supply port 105*b* into the passage unit 9 flows in each manifold channel 105 and then it is distributed into each sub manifold channel 105*a*. Ink in each sub manifold channel 105*a* flows into the corresponding individual ink passage 132; and flows in the corresponding aperture 112, which functions as a throttle, and the corresponding pressure chamber 110; and then reaches the corresponding nozzle 108.

Next, the actuator units 21 will be described. As shown in FIG. 3, each of the four actuator units 21 has a trapezoidal shape in a plan view. The actuator units 21 are arranged zigzag so as to avoid the ink supply ports 105*b*. The opposite parallel sides of each actuator unit 21 extend longitudinally of the passage unit 9. The oblique sides of neighboring actuator units 21 overlap each other longitudinally of the passage unit 9, that is, in the main scanning direction.

Figure 6A:
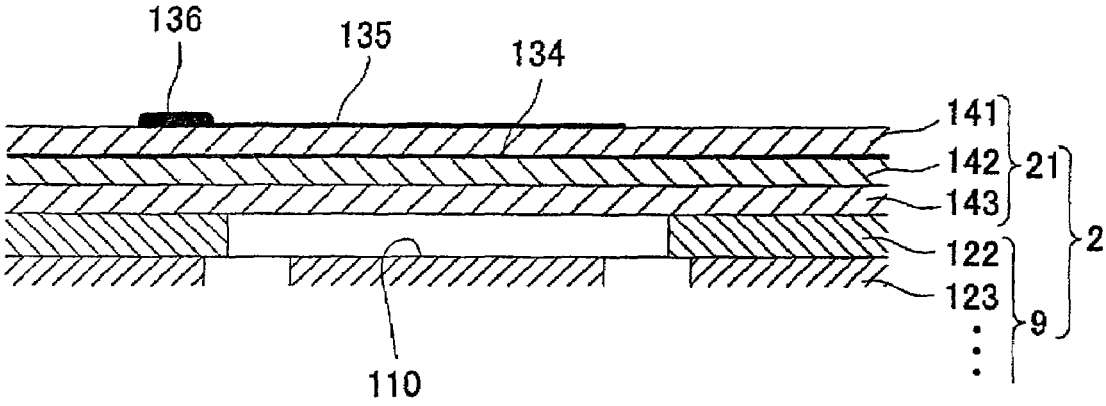
FIG. 6A is a partial sectional view of an actuator unit shown in FIG. 4.
Figure 6B:
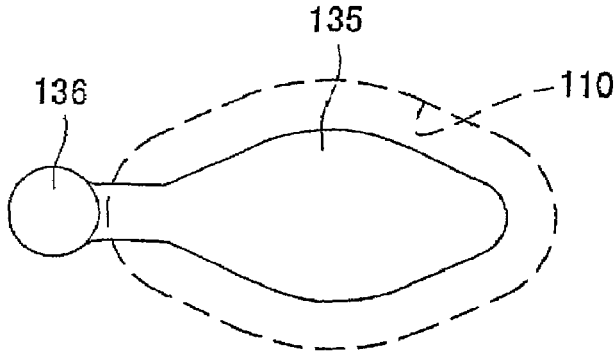
FIG. 6B is a partial plan view of the actuator unit.
Figure 7:
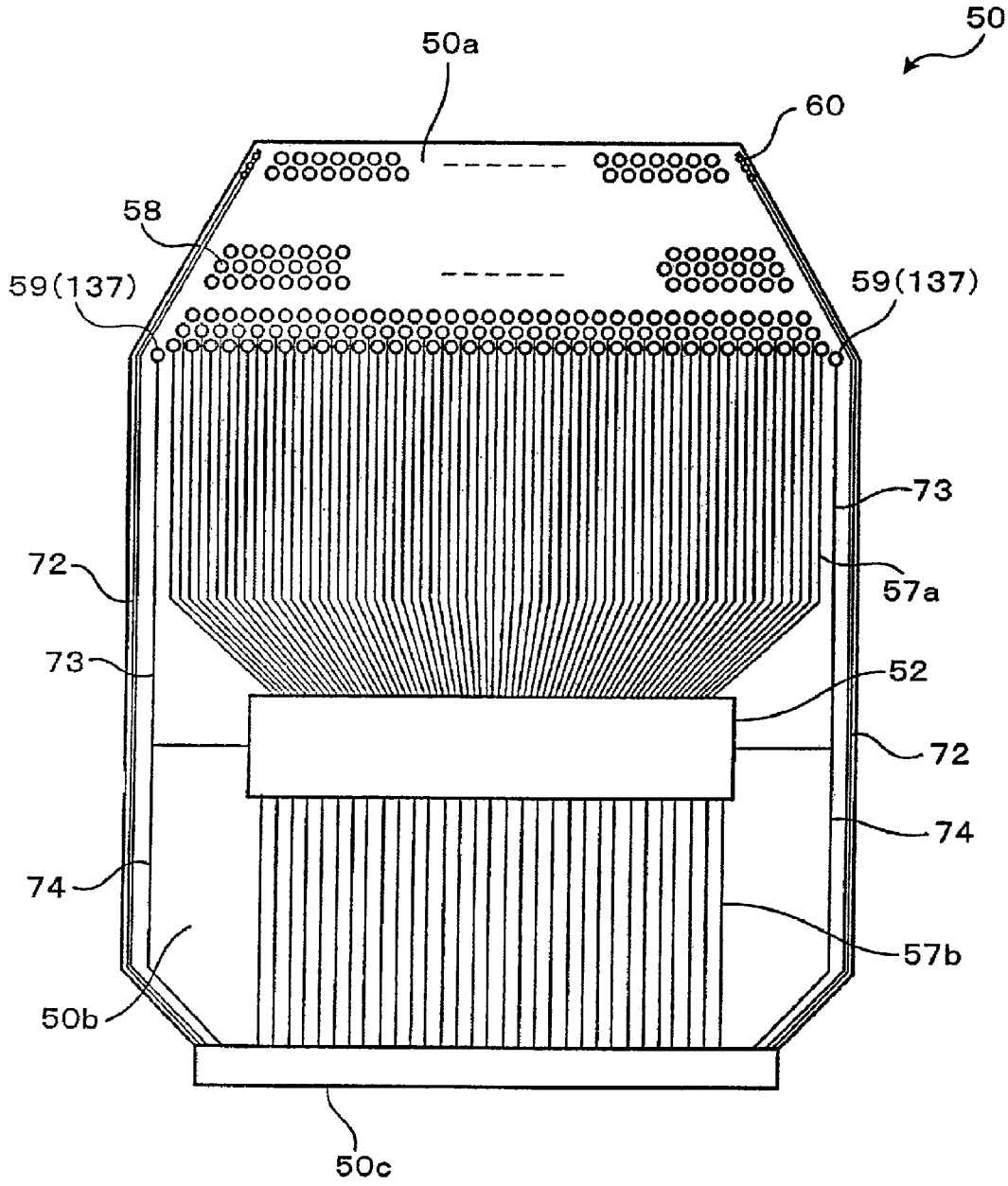
FIG. 7 is a plan view of a chip-on film (COF) shown in FIG. 2.
Figure 9A:
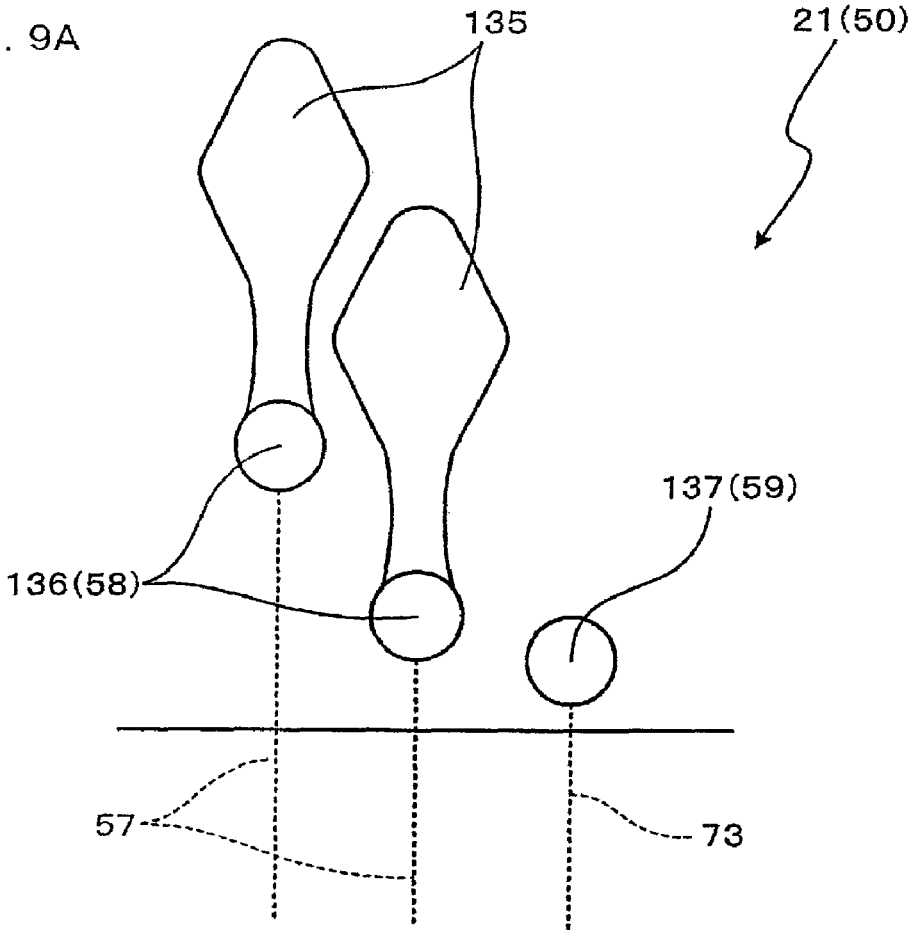
FIGS. 9A, 9B, and 9C show positional relations between check terminals and a common electrode shown in FIG. 8.

As shown in FIG. 6A, each actuator unit 21 includes three piezoelectric layers 141 to 143 each made of a piezoelectric zirconate titanate (PZT)-base ceramic material having ferroelectricity. Individual electrodes 135 are formed on a surface of the uppermost piezoelectric layer 141, that is, on the bonding face of the actuator unit 21, so as to be opposed to the respective pressure chambers 110. A common electrode 134 is interposed between the uppermost piezoelectric layer 141 and the second uppermost piezoelectric layer 142 over the whole area. As shown in FIG. 6B, each individual electrode 135 has a substantially rhombic shape in a plan view similar to each pressure chamber 110. In a plan view, the major part of the individual electrode 135 is within the region of the pressure chamber 110. One acute portion of the substantially rhombic individual electrode 135 is extended out of the corresponding pressure chamber 110. A circular individual land 136 thicker than the individual electrode 135 and electrically connected to the individual electrode 135 is provided on the front end of the extension of the individual electrode 135. A not-shown COM land and check lands 137 as shown in FIGS. 7 and 9A, which are electrically connected to the common electrode 134, are formed on the surface of the piezoelectric layer 141. The check lands 137 are positioned near both ends of the long side of the piezoelectric layer 141, that is, the bottom side of the trapezoid, so as to be closer to the long side than any individual electrode 135. The surface of the piezoelectric layer 141 is the bonding face to which check terminals 59 of the corresponding COF 50 are bonded as described later.

The common electrode 134 is grounded so that a reference potential is given to the common electrode 134 evenly in the regions corresponding to all pressure chambers 110. On the other hand, individual electrodes 135 are electrically connected via their individual lands 136 and internal wires of the corresponding COF 50 to respective terminals on the corresponding driver IC 52. Thus, the driver IC 52 can supply a drive signal to only one or more desired individual electrodes 135. That is, the portions of the actuator unit 21 overlapping the respective individual electrodes 135 in a plan view function as individual actuators. In other words, the same number of actuators as the pressure chambers 110 are constructed in the actuator unit 21.

Next, a driving method of the actuator unit 21 will be described. The piezoelectric layer 141 has been polarized along its thickness. On the other hand, the piezoelectric layers 142 and 143 are inactive layers that are not deformed by themselves. The piezoelectric layers 141 to 143 are fixed to the upper face of the cavity plate 122 that defines the pressure chambers 110. Thus, when an individual electrode 135 is put at a potential different from that of the common electrode 134 to apply an electric field to the piezoelectric layer 141 in the polarization direction, the portion of the piezoelectric layer 141 to which the electric field has been applied serves as an active portion to be deformed by the piezoelectric effect. When the electric field is applied in the same direction as the polarization of the piezoelectric layer 141, the active portion increases in its thickness and decreases in its area. When a difference in the quantity of deformation in area is generated between the portion of the piezoelectric layer 141 to which the electric field has been applied, and the piezoelectric layers 142 and 143 below the portion of the piezoelectric layer 141, the whole of the piezoelectric layers 141 to 143 is unimorph-deformed so as to be convex toward the corresponding pressure chamber 110. Thereby, pressure, that is, ejection energy, is given to ink in the pressure chamber 110 to generate a pressure wave in the pressure chamber 110. The generated pressure wave propagates from the pressure chamber 110 to the corresponding nozzle 108 to eject ink droplets from the nozzle 108.

In this embodiment, any individual electrode 135 is in advance put at a predetermined potential different from the ground potential. Every time when an ejection request is issued, the driver IC 52 outputs a pulse signal to a target individual electrode 135 so that the individual electrode 135 is once put at the ground potential and then again put at the predetermined potential at a predetermined timing. In this case, at the timing when the individual electrode 135 is put at the ground potential, the pressure of ink in the corresponding pressure chamber 110 lowers so that ink is sucked from the corresponding sub manifold channel 105*a* into the corresponding individual ink passage 132. Afterward, at the timing when the individual electrode 135 is again put at the predetermined potential, the pressure of ink in the pressure chamber 110 rises so that ink droplets are ejected from the nozzle 108. That is, a rectangular pulse signal is given to the individual electrode 135. The width of the pulse is substantially equal to the acoustic length (AL) that is the time length in which the pressure wave in the pressure chamber 110 propagates from the outlet of the sub manifold channel 105*a* to the tip end of the nozzle 108. In this design, the positive pressure wave having returned by reflection with having been inverted in phase is superimposed on the positive pressure newly applied by the actuator unit 21. As a result, large pressure can be applied to ink in the pressure chamber 110.

Next, the COF 50 will be described with reference to FIG. 7. FIG. 7 shows the length of the COF 50 to be shorter than its actual length. As shown in FIG. 7, the COF 50 includes a terminal disposition region 50*a* having substantially the same trapezoidal profile in a plan view as the actuator unit 21; a wiring region 50*b* continuous from the long side of the terminal disposition region 50*a*; and a terminal 50*c* positioned at an end of the wiring region 50*b*. The terminal 50*c* is to be connected to the corresponding connector 54*a* of the control substrate 54.

The terminal disposition region 50*a* is fixed to the bonding face of the corresponding actuator unit 21 parallel to the face. On the other hand, the wiring region 50*b* is not fixed to the bonding face of the actuator unit 21. In the terminal disposition region 50*a* disposed are a plurality of output terminals 58 to be bonded to the respective individual lands 136 of the individual electrodes 135; ground terminals 60 to be bonded to not-shown COM lands electrically connected to the common electrode 134; and two check terminals 59 to be bonded to check lands 137 as shown in FIG. 9A. The two check terminals 59 are disposed near both ends of the long side of the terminal disposition region 50*a* so as to be closer to the long side than any output terminal 58. Thus, when the COF 50 has been bonded to the bonding face of the actuator unit 21, the two check terminals 59 are located near both ends of the long side of the actuator unit 21 so as to be closer to the wiring region sob than any individual electrode 135. In this embodiment, each check terminal 59 is at a very small distance from the output terminal nearest to the check terminal 59.

A driver IC 52 is mounted at the lateral center of the wiring region 50*b*. In the wiring region 50*b* formed are output wires 57*a* to connect the output terminals 58 to not-shown drive signal terminals of the driver IC 52; control wires 57*b* to connect not-shown control terminals of the driver IC 52 to the terminal 50*c*; check wires 73 connected to the respective check terminals 59; and ground wires 74 as control signal reference potential patterns that are put at a reference potential for a control signal to control the driver IC 52. Near lateral both ends of the COF 50, COM patterns 72 are formed as drive signal reference potential patterns that extend along the periphery of the terminal disposition region 50*a* and the wiring region 50*b*. Ground terminals 60 are disposed at the ends of the COM patterns 72 in the terminal disposition region 50*a*. The ground wires 74 are formed between the driver IC 52 and the COM patterns 72. The check wires 73 are connected to the ground wires 74 in the vicinity of the driver IC 52.

The terminal 50*c* to be connected to the connector 54*a* of the control substrate 54 has a plurality of not-shown terminals connected to the control wires 57*b*, the ground wires 74, and the COM patterns 72. The ground wires 74 and the COM patterns 72 are short-circuited with each other on the control substrate 54.

Next, the driver IC 52 will be described in detail with reference to FIGS. 8, 9A, 9B, and 9C. FIG. 9A is a partial enlarged plan view of a COF 50 and an actuator unit 21. FIG. 9B is a partial sectional view of the COF 50 and the actuator unit 21 when the COF 50 is not separated from the actuator unit 21. FIG. 9C is a partial sectional view of the COF 50 and the actuator unit 21 when the COF 50 is separated from the actuator unit 21. Separation of the COF 50 from the actuator unit 21 means a state in which one or more individual lands 136 have been peeled off from the corresponding output terminals 58.

Figure 8:
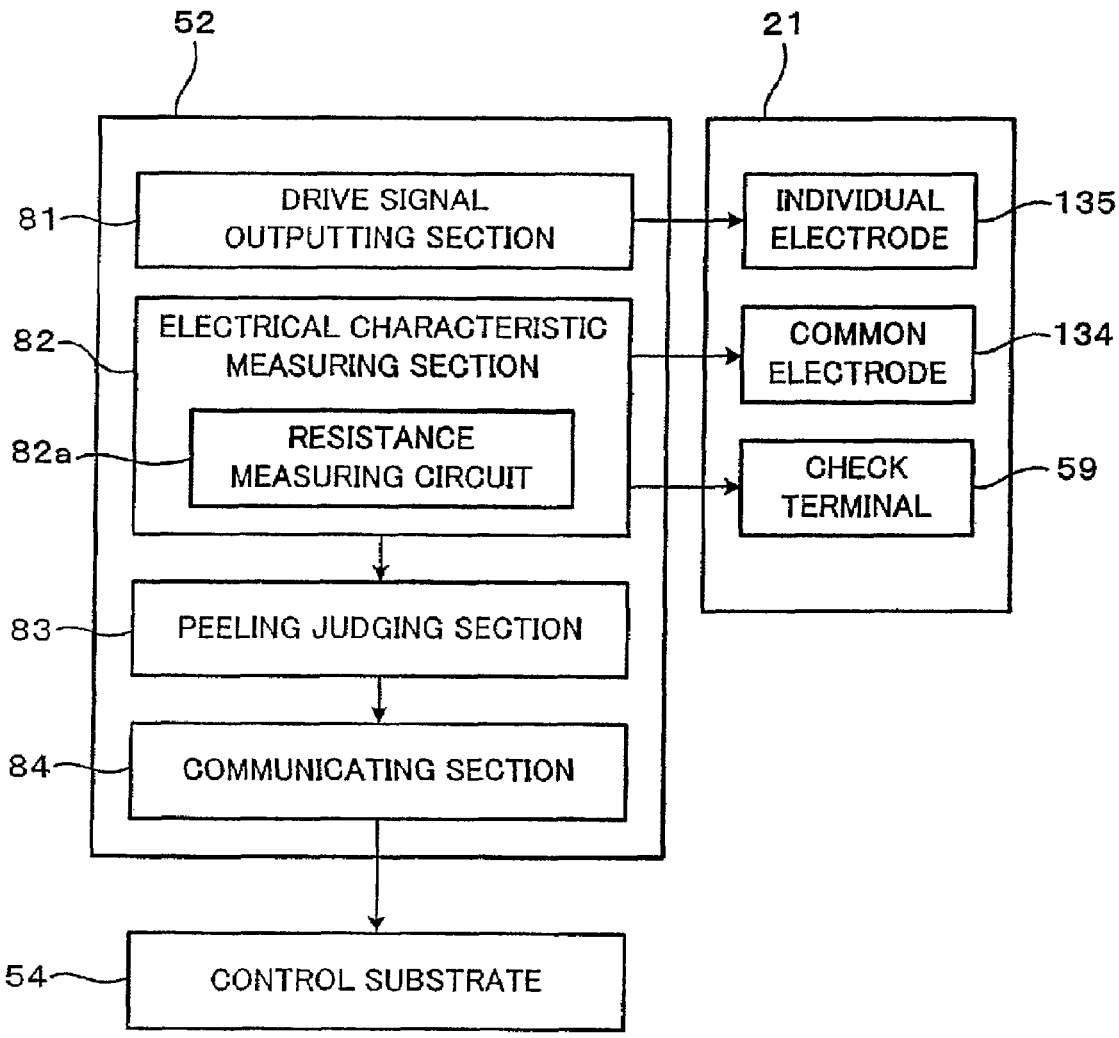
FIG. 8 is a block diagram of a driver IC shown in FIG. 2.
Figure 9B:
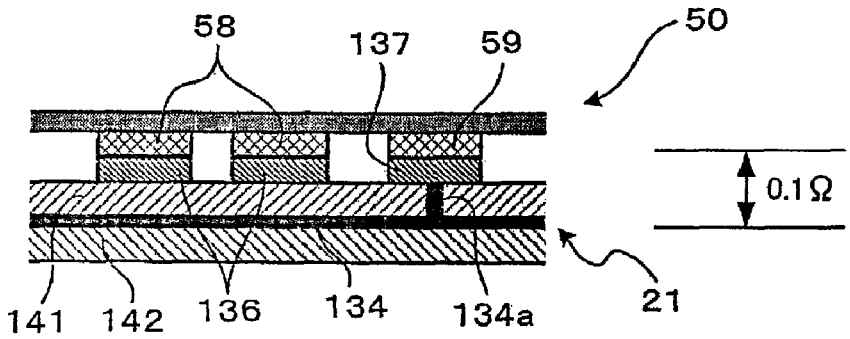
Figure 9C:
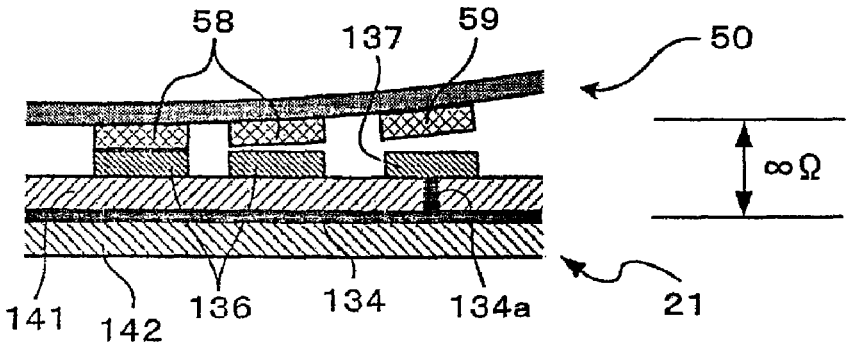

As shown in FIG. 8, the driver IC 52 as a drive signal outputting unit includes a drive signal outputting section 81, an electrical characteristic measuring section 82 as a measuring unit, a peeling judging section 83 as a judging unit, and a communicating section 84. On the basis of an instruction from a not-shown higher-rank apparatus, for example, a host computer, the drive signal outputting section 81 outputs a drive signal to drive the actuator unit 21. The drive signal output from the drive signal outputting section 81 is supplied to target individual electrodes 135 via a drive signal terminal, the corresponding output wires 57*a*, and the corresponding output terminals 58 of the driver IC 52.

As shown in FIGS. 9B and 9C, an internal wire 134*a* is formed through the thickness of the piezoelectric layer 141 so as to connect the check land 137 to the common electrode 134. Thus, when the COF 50 is not separated from the actuator unit 21, the check terminal 59 is electrically connected to the common electrode 134 via the check land 137 and the internal wire 134*a*. In this state, the resistance value between the check terminal 59 and the common electrode 134 is about 0.1 ohm. In this embodiment, the check terminal 59 is at a very small distance from the output terminal 58 nearest to the check terminal 59. Therefore, when any output terminal 58 has not been peeled off from the corresponding individual land 136, the check terminal 59 may also have not been peeled off from the check land 137. In this embodiment, as described above, two check terminals 59 are disposed closer to the wiring region 50*b* in the bonding face than any individual electrode 135. Therefore, as shown in FIG. 9C, when the COF 50 is separated from the actuator unit 21, a check terminal 59 is peeled off from the corresponding check land 137 prior to any output terminal 58 being peeled off from the corresponding individual electrode 136. When a check terminal 59 has been peeled off from the corresponding check land 137, the resistance value between the check terminal 59 and the common electrode 134 becomes infinite ohm.

The electrical characteristic measuring section 82 measures an electrical characteristic with respect to the two check terminals 59. For this purpose, the electrical characteristic measuring section 82 includes therein a resistance measuring circuit 82*a*. The resistance measuring circuit 82*a* measures the resistance between each check terminal 59 and the common electrode 134 as the electrical characteristic with respect to the check terminal 59.

Figure 10:
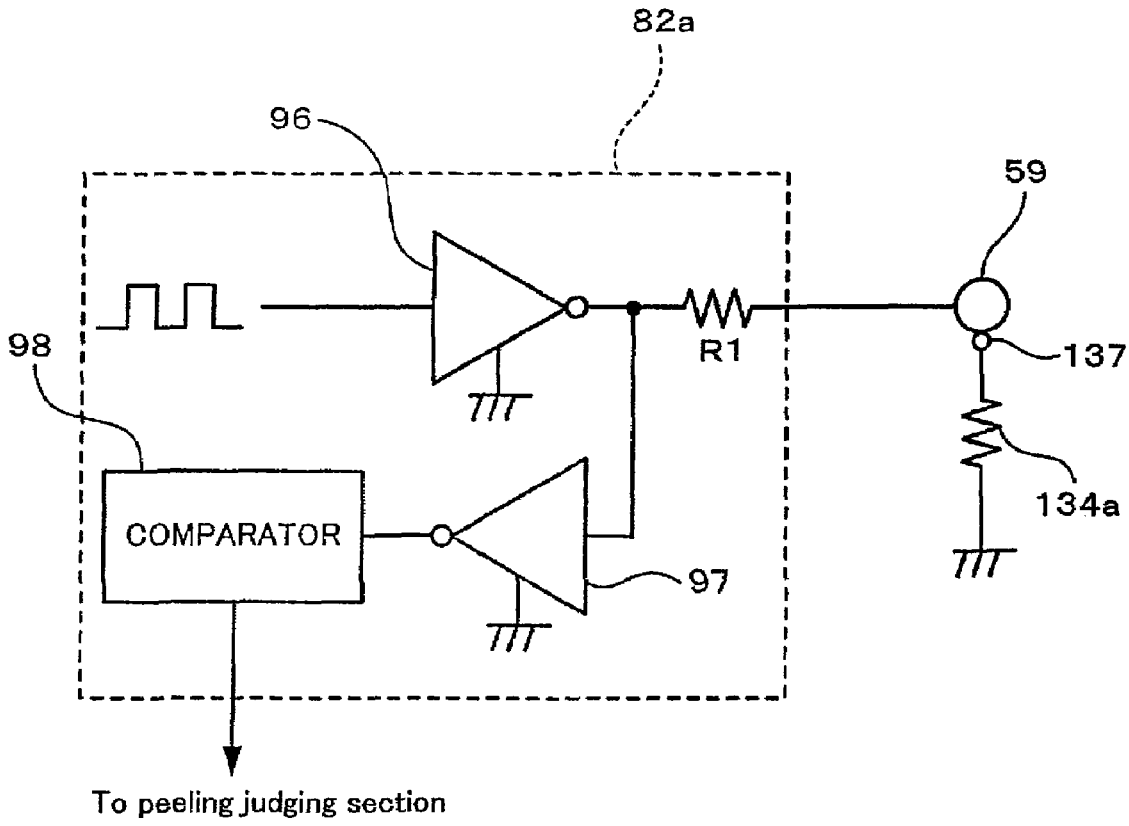
FIG. 10 is a schematic circuit diagram showing an internal construction of a resistance measuring circuit shown in FIG. 8.

The resistance measuring circuit 82*a* will be described. FIG. 10 is a schematic circuit diagram showing an internal construction of the resistance measuring circuit 82*a*. As shown in FIG. 10, the resistance measuring circuit 82*a* includes a pair of inverters 96 and 97 and a comparator 98. When a pulse train signal is input, the inverter 96 outputs a check signal to a check terminal 59 via a drive resistance R1. The inverter 97 outputs to the comparator 98 the check signal sent from the inverter 96. The comparator 98 compares the output voltage from the inverter 97 with a high-level reference voltage. As described above, when the COF 50 is not separated from the actuator unit 21, the resistance value between either check terminal 59 and the common electrode 134 is about 0.1 ohm. In this state, therefore, the output voltage of the inverter 96 is always low while the output voltage of the inverter 97 is always high. On the other hand, when the COF 50 is separated from the actuator unit 21, the resistance value between a check terminal 59 and the common electrode 134 becomes infinite ohm. In this case, the output voltage of the inverter 96 changes between high and low levels in accordance with the input pulse train signal, and the output voltage of the inverter 97 also changes between high and low levels.

When the output voltage of the inverter 97 corresponds to the reference voltage as both are at high level, the comparator 98 outputs to the peeling judging section 83 a measurement result indicating that the resistance value between the check terminal 59 and the common electrode 134 is about 0.1 ohm. When the output of the inverter 97 does not correspond to the reference voltage, that is, when the output of the inverter 97 has once become low level, the comparator 98 outputs to the peeling judging section 83 a measurement result indicating that the resistance value between the check terminal 59 and the common electrode 134 is infinite ohm.

On the basis of the measurement result of the resistance measuring circuit 82*a*, the peeling judging section 83 judges whether or not the COF 50 is separated from the actuator unit 21, that is, whether or not a check terminal 59 has been peeled off from the corresponding check land 137. When the resistance value as the measurement result of the resistance measuring circuit 82*a* is about 0.1 ohm, the peeling judging section 83 decides that the COF 50 is not separated from the actuator unit 21. When the resistance value is infinite ohm, the peeling judging section 83 decides that the COF 50 is separated from the actuator unit 21.

The communicating section 84 sends the judgment result of the peeling judging section 83 to the control substrate 54. In a modification, the destination of the signal from the communication section 84 may be a checking section for checking the inkjet head 1 in the manufacturing process of the inkjet head 1.

In the above-described case, the resistance value is infinite ohm when the check terminal 59 has been peeled off from the check land 137. However, when an external force is applied to the bonding interface between the check terminal 59 and the check land 137, the force may bring about damage on the bonding interface causing partial peeling. In this case, the resistance value becomes higher than 0.1 ohm in accordance with the degree of the damage on the bonding interface.

Even when the bonding interface between the check terminal 59 and the check land 137 is in such a high-resistance state, the peeling judging section 83 decides that the COF 50 is separated. By way of example, it is assumed that the drive resistance R1 is 100 ohm and the inverter 96 allows a current of 10 mA to flow at 24 V. In this example, separation is judged by a threshold of the inverter 97 of 2.5 V. When the condition of the bonding interface is good, that is, the resistance value is about 0.1 ohm, the input voltage to the inverter 97 is 1.001 V. Because the threshold of the inverter 97 is 2.5 V, the output of the inverter 97 is at high level. Therefore, the peeling judging section 83 decides that the check terminal 59 has not been peeled off from the check land 137. On the other hand, when the bonding interface has been damaged to have a resistance value of 1 kilohm, the input voltage to the inverter 97 is 10 V, which is higher than the threshold of 2.5 V. In this case, the output of the inverter 97 becomes low level. Therefore, the peeling judging section 83 decides that the check terminal 59 has been peeled off from the check land 137. In this example, when the resistance value of the bonding interface exceeds 150 ohm, the peeling judging section 83 decides that the check terminal 59 has been peeled off from the check land 137.

As described above, by setting in advance the electrical characteristics of the inverter 96 including its threshold, and the drive resistance to appropriate values, even when the check terminal 59 has not completely been peeled off from the check land 137, bonding defect before complete peeling can be detected.

In this embodiment, as described above, by a simple method in which the resistance value between each check terminal 59 and the common electrode 134 is measured, it can be judged whether or not the check terminal 59 provided on the COF 50 has been peeled off from the corresponding check land 137 provided on the actuator unit 21. Therefore, in the manufacturing process of the inkjet head 1, the manufacturer can easily find out separation of the COF 50 from the actuator unit 21. In addition, after shipping the inkjet head 1 or the inkjet printer 101, the manufacturer or a user can easily find out separation of the COF 50 from the actuator unit 21 due to, for example, a change in temperature with time. Further, the electrical characteristic measuring section 82 can be realized by a simple circuit construction.

In addition, because each ground wire 74 is formed between the driver IC 52 and a COM pattern 72 and a check wire 73 is connected to the ground wire 74 in the vicinity of the driver IC 52, it is not necessary to extend the check wire 73 to the terminal 50*c*. This can reduce the surface area of the COF 50.

Further, because two check terminals 59 are disposed closer to the wiring region 50*b* than any individual electrode 135, separation of the COF 50 from the actuator unit 21 can surely be found out.

Further, because the electrical characteristic measuring section 82 measures the resistance value between the common electrode 134 and each check terminal 59, the electrical characteristic measuring section 82 can be realized by a simple construction.

In the above-described embodiment, each check land 137 is electrically connected to the common electrode 134. In a modification, however, each check land 137 may be electrically connected to the passage unit 9 as a metallic member. This can realize the electrical characteristic measuring section as a measuring unit by a simple construction. In this modification, the passage unit 9 is preferably put at the ground potential via a not-shown frame or the like.

Second Embodiment

Figure 11:
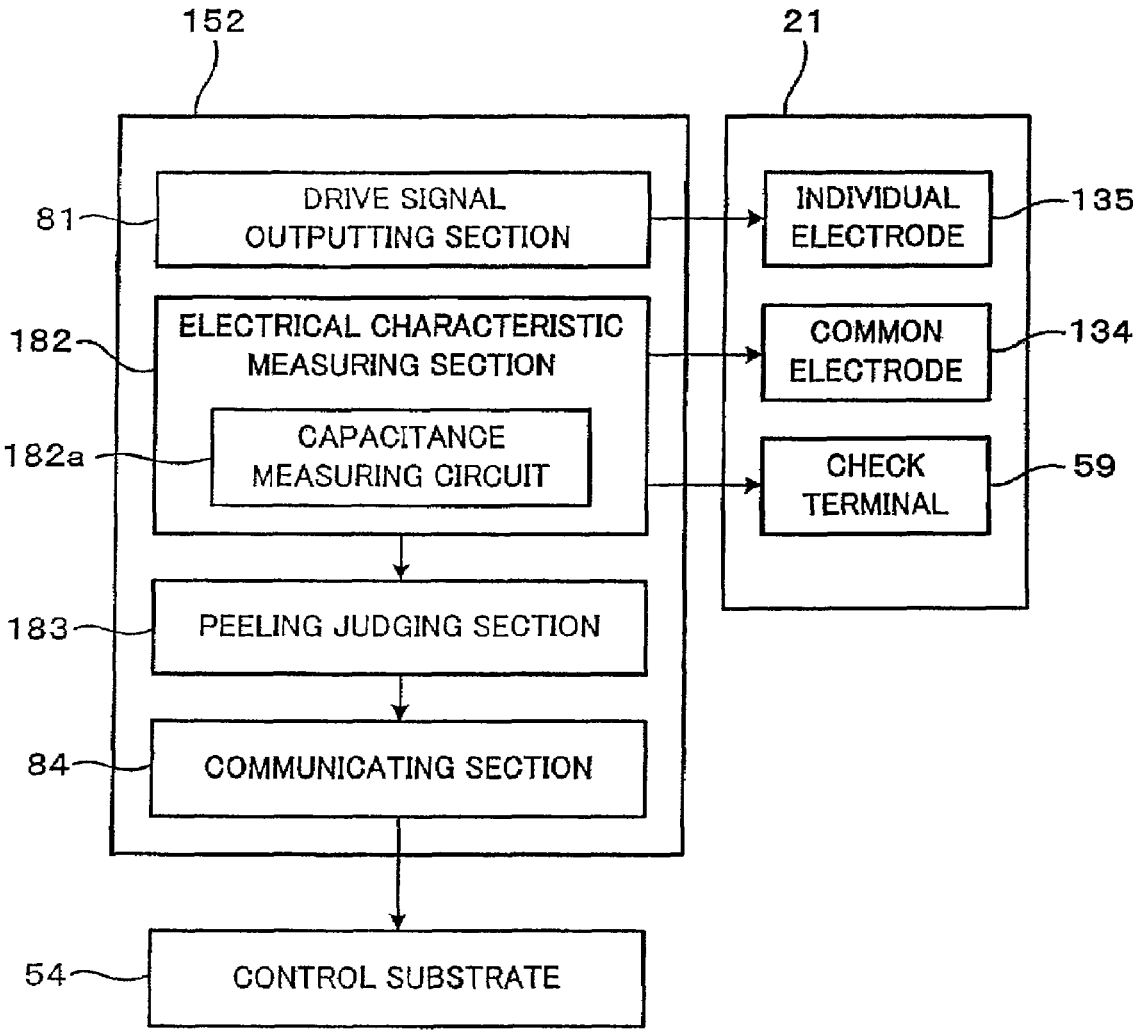
FIG. 11 is a block diagram of a driver IC included in an inkjet printer according to a second embodiment of the present invention.
Figure 12A:
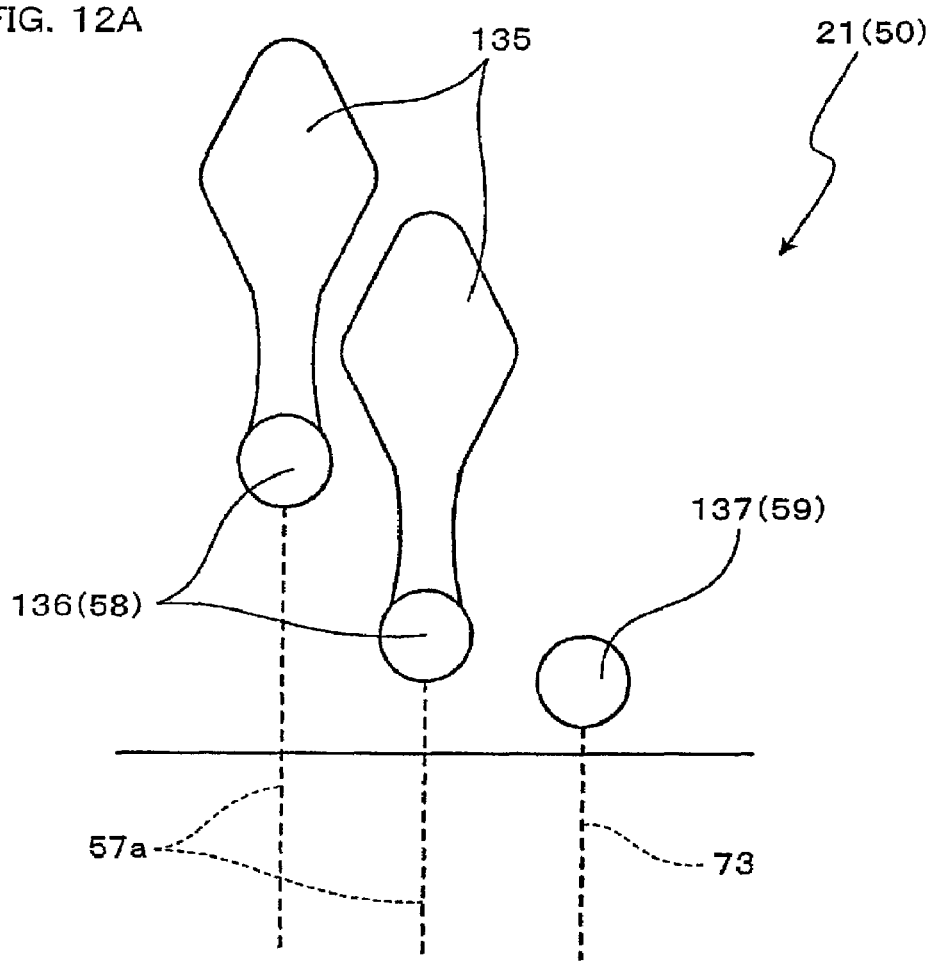
FIGS. 12A, 12B, and 12C show positional relations between check terminals and a common electrode shown in FIG. 11.
Figure 12B:
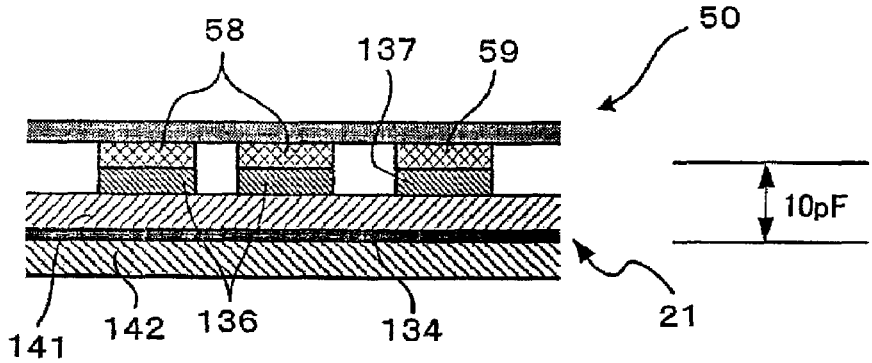
Figure 12C:
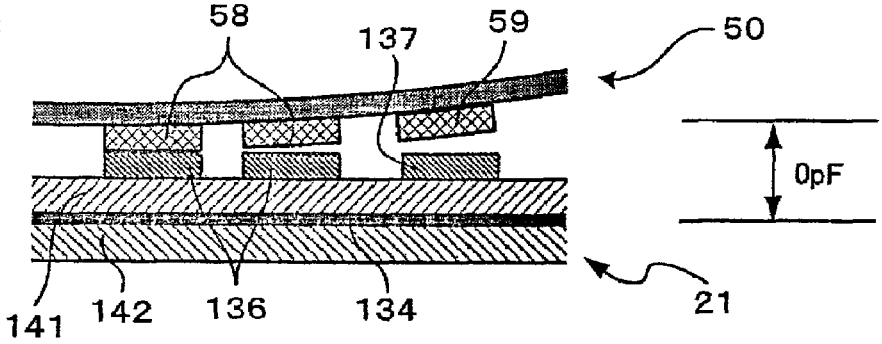

Next, an inkjet printer according to a second embodiment of the present invention will be described with reference to FIGS. 11, 12A, 12B, and 12C. In this embodiment, substantially the same components and functional parts as in the first embodiment are denoted by the same references as in the first embodiment, respectively, and the description thereof will be omitted. FIG. 11 is a block diagram of a driver IC 152 included in the inkjet printer of the second embodiment. FIG. 12A is a partial enlarged plan view of a COF 50 and an actuator unit 21. FIG. 12B is a partial sectional view of the COF 50 and the actuator unit 21 when the COF 50 is not separated from the actuator unit 21. FIG. 12C is a partial sectional view of the COF 50 and the actuator unit 21 when the COF 50 is separated from the actuator unit 21.

As shown in FIG. 11, the driver IC 152 includes a drive signal outputting section 81, an electrical characteristic measuring section 182 as a measuring unit, a peeling judging section 183 as a judging unit, and a communicating section 84.

In this embodiment, as shown in FIGS. 12B and 12C, the check terminal 59 and the check land 137 in each pair are electrically insulated from the common electrode 134 by the piezoelectric layer 141. That is, the check terminal 59 and the check land 137 cooperate with the piezoelectric layer 141 and the common electrode 134 to form a capacitor. When the COF 50 is not separated from the actuator unit 21, the capacitance between the check terminal 59 and the common electrode 134, that is, the capacitance of the capacitor constituted by the check terminal 59 and the common electrode 134, is about 10 pF. As shown in FIG. 12C, when the check terminal 59 is been peeled off from the check land 137, the peeling considerably increases the distance between the check terminal 59 and the common electrode 134. As a result, the capacitance between the check terminal 59 and the common electrode 134 becomes substantially 0 pF.

The electrical characteristic measuring section 182 measures an electrical characteristic with respect to each check terminal 59. For this purpose, the electrical characteristic measuring section 182 includes therein a capacitance measuring circuit 182*a*. The capacitance measuring circuit 182*a* measures the capacitance between the check terminal 59 and the common electrode 134 as the electrical characteristic with respect to the check terminal 59.

Figure 13:
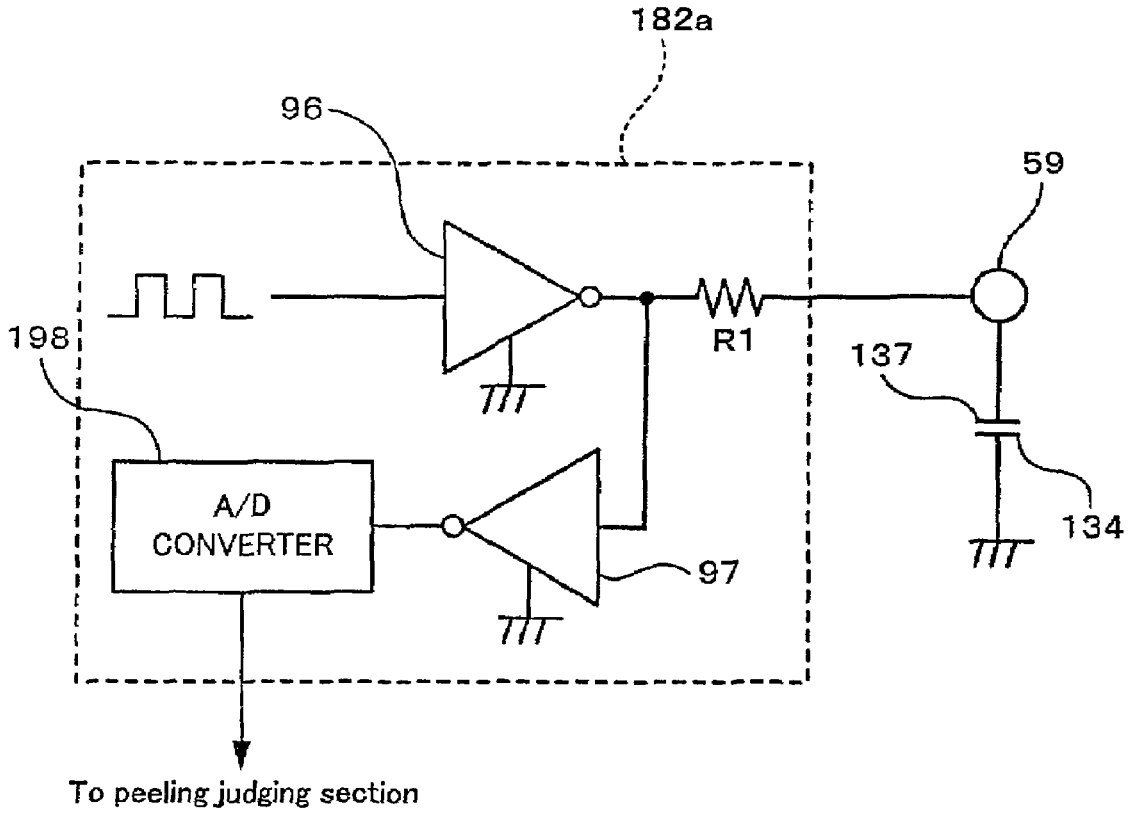
FIG. 13 is a schematic circuit diagram showing an internal construction of a capacitance measuring circuit shown in FIG. 11.

The capacitance measuring circuit 182*a* will be described with reference to FIG. 13. FIG. 13 is a schematic circuit diagram showing an internal construction of the capacitance measuring circuit 182*a*. As shown in FIG. 13, the capacitance measuring circuit 182*a* includes a pair of inverters 96 and 97 and an A/D converter 198. When a pulse signal is input, the inverter 96 outputs a check pulse signal to a check terminal 59 via a drive resistance R1. The inverter 97 outputs to the A/D converter 198 the check pulse signal sent from the inverter 96. The A/D converter 198 converts the output voltage of the inverter 97 into a digital signal to be output. As described above, when the COF 50 is not separated from the actuator unit 21, the capacitance between the check terminal 59 and the common electrode 134 is about 10 pF. As a result, the rise time and fall time of the check pulse signal output from the inverter 96 are longer than those of the input pulse signal. On the other hand, when the COF 50 is separated from the actuator unit 21, the capacitance between the check terminal 59 and the common electrode 134 is 0 pF. As a result, the rise time and fall time of the check pulse signal output from the inverter 96 are substantially equal to those of the input pulse signal.

The A/D converter 198 samples the output voltage of the inverter 97 at a timing when a predetermined time has elapsed after the pulse signal input to the inverter 96 rises. At this time, the higher the capacitance between the check terminal 59 and the common electrode 134, the longer the rise time of the pulse and the lower the sampled output voltage. Conversely, the lower the capacitance between the check terminal 59 and the common electrode 134, the shorter the rise time of the pulse and the higher the sampled output voltage. The capacitance measuring circuit 182*a* outputs as a capacitance measurement result a digital signal that indicates the sampled output voltage, to the peeling judging section 183.

On the basis of the measurement result of the capacitance measuring circuit 182*a*, the peeling judging section 183 judges whether or not the COF 50 is separated from the actuator unit 21, that is, whether or not a check terminal 59 has been peeled off from the corresponding check land 137. When the voltage value indicating the capacitance value as the measurement result of the capacitance measuring circuit 182*a* is lower than a predetermined value, the peeling judging section 183 decides that the COF 50 is not separated from the actuator unit 21. When the voltage value indicating the capacitance value is higher than the predetermined value, the peeling judging section 183 decides that the COF 50 is separated from the actuator unit 21.

Also in this embodiment, like the above-described first embodiment, by setting an appropriate threshold with respect to the output voltage to be sampled by the A/D converter 198, bonding defect before complete peeling can be detected.

In this embodiment, as described above, by a simple method in which the capacitance between each check terminal 59 and the common electrode 134 is measured, it can be judged whether or not the COF 50 is separated from the actuator unit 21.

<First Modification>

Figure 14:
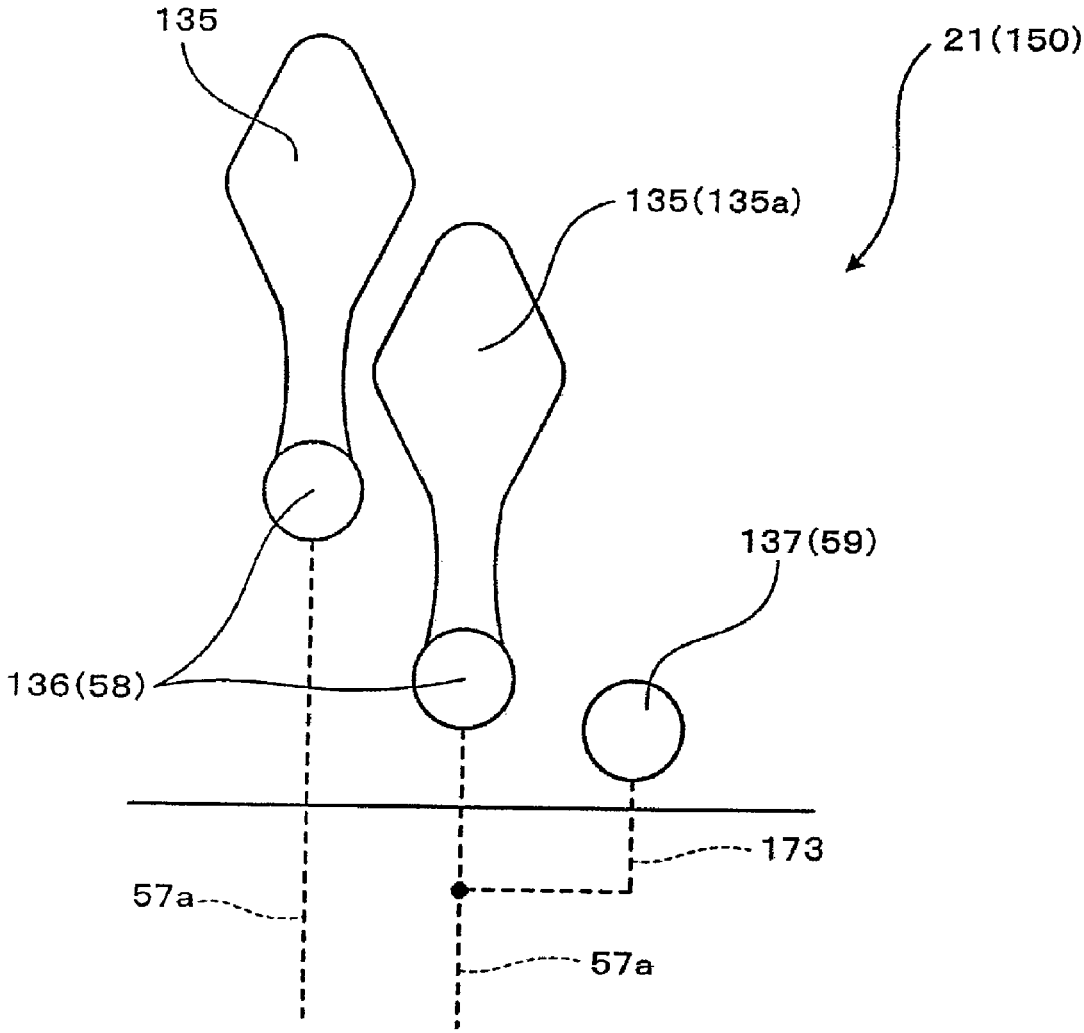
FIG. 14 is a partial enlarged plan view of a COF according to a modification of the second embodiment of the present invention.

A modification of the second embodiment will be described with reference to FIG. 14. FIG. 14 is a partial enlarged plan view of a COF 150 of the modification. On the COF 150, as shown in FIG. 14, the check wire 173 connected to each check terminal 59 via the corresponding check land 137 is connected to the output wire 57*a* connected to a check individual electrode 135*a* that is the individual electrode 135 neighboring the check terminal 59. In this manner, the check terminal 59 is electrically connected to the check individual electrode 135*a*. The capacitance measuring circuit 182*a* measures the sum of the capacitance value between the common electrode 134 and the check terminal 59 and the capacitance value between the common electrode 134 and the check individual electrode 135*a*. As the inverter 96 of the capacitance measuring circuit 182*a*, a part is used of the driving circuit for outputting a drive signal to the check individual electrode 135*a*.

In this modification, because a part of the driving circuit for outputting a drive signal to the check individual electrode 135*a* is used as the inverter 96 of the capacitance measuring circuit 182*a*, this can suppress an increase in the circuit scale of the driver IC 52.

In this modification, in order to equalize the drive characteristics of active portions formed in the piezoelectric layer 141 in accordance with individual electrodes 135 including the check individual electrode 135*a*, the driving circuit for outputting a drive signal to the check individual electrode 135*a* is preferably constructed so that the current value of the drive signal to be output to the check individual electrode 135*a* is larger than the current value of the drive signal to be output to any other individual electrode 135 than the check individual electrode 135*a*. For this purpose, for example, the ON resistance of a transistor in the driving circuit for outputting a drive signal to the check individual electrode 135*a* is set to be lower than that of any other driving circuit. This can suppress variation in the drive characteristics of the active portions.

Third Embodiment

Figure 15:
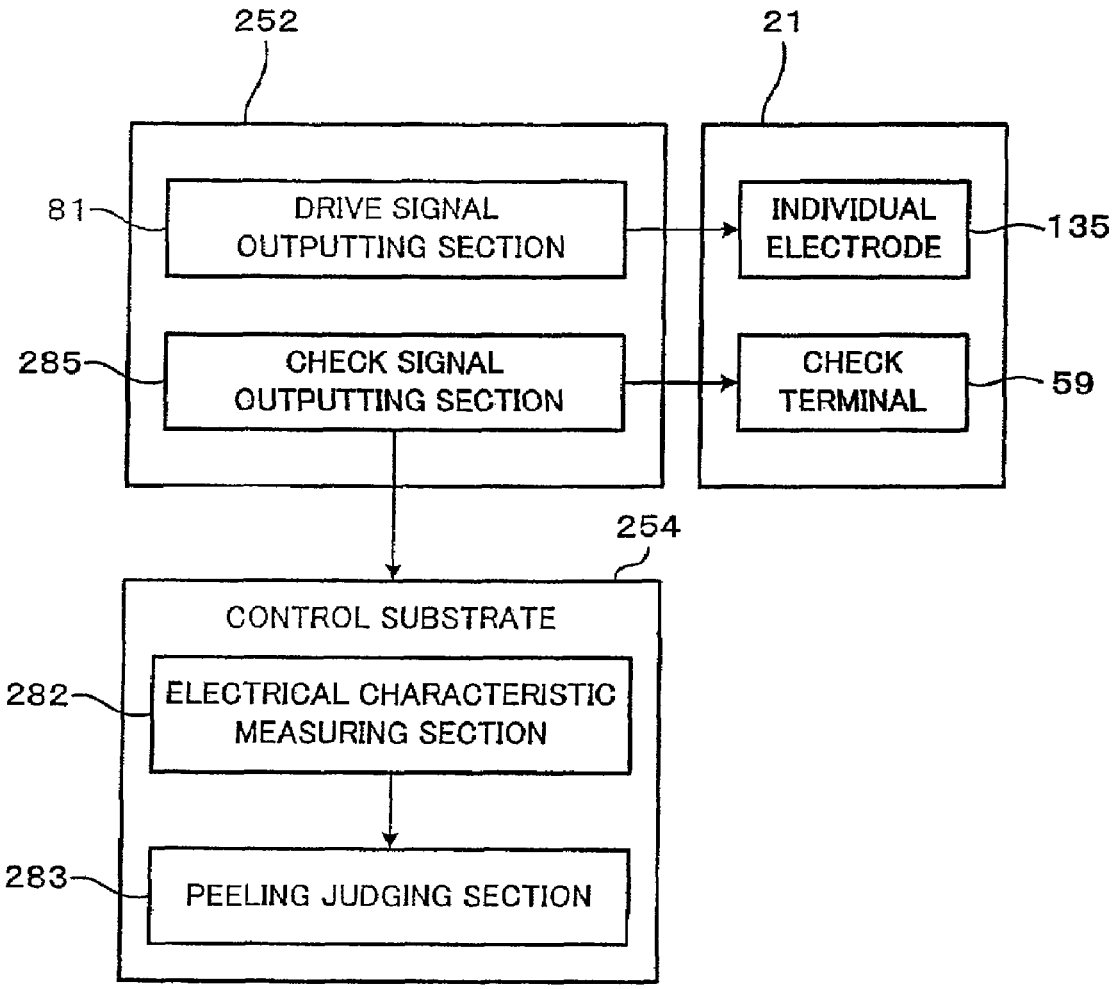
FIG. 15 is a block diagram of a driver IC included in an inkjet printer according to a third embodiment of the present invention.

Next, an inkjet printer according to a third embodiment of the present invention will be described with reference to FIG. 15. In this embodiment, substantially the same components and functional parts as in the first or second embodiment are denoted by the same references as in the first or second embodiment, respectively, and the description thereof will be omitted. FIG. 15 is a block diagram of a driver IC 252 and a control substrate 254 included in the inkjet printer of this embodiment. As shown in FIG. 15, the driver IC 252 includes a drive signal outputting section 81 and a check signal outputting section 285. The control substrate 254 includes an electrical characteristic measuring section 282 as a measuring unit, and a peeling judging section 283 as a judging unit.

Figure 16:
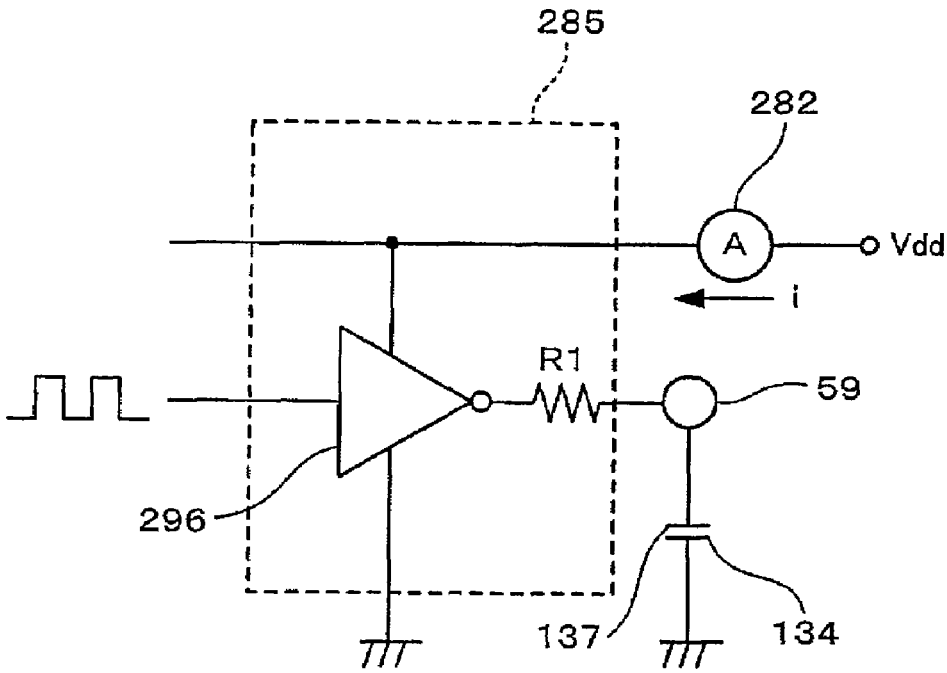
FIG. 16 is a schematic circuit diagram showing internal constructions of a check signal outputting section and an electrical characteristic measuring section shown in FIG. 15.

The check signal outputting section 285 and the electrical characteristic measuring section 282 will be described with reference to FIG. 16. FIG. 16 is a schematic circuit diagram showing internal constructions of the check signal outputting section 285 and the electrical characteristic measuring section 282. As shown in FIG. 16, the check signal outputting section 285 includes an inverter 296 that receives a pulse signal and thereby outputs a check pulse signal to each check terminal 59 via a drive resistance R1. The electrical characteristic measuring section 282 is for measuring an electrical characteristic with respect to each check terminal 59. In this embodiment, the electrical characteristic measuring section 282 measures the power consumption of the inverter 296 when the inverter 296 outputs a check pulse signal to the check terminal 59. The electrical characteristic measuring section 282 outputs its measurement result to the peeling judging section 283.

When the COF 50 is not separated from the actuator unit 21, the capacitance value between the check terminal 59 and the common electrode 134 is about 10 pF, as shown in FIG. 12B. Thus, when the inverter 296 outputs a check signal, a current flows to the ground via the check terminal 59 and the common electrode 134. This increases the power consumption of the inverter 296. On the other hand, when the COF 50 is separated from the actuator unit 21, the capacitance value between the check terminal 59 and the common electrode 134 becomes 0 pF. Thus, no current flows to the ground via the check terminal 59 and the common electrode 134. This decreases the power consumption of the inverter 296.

Referring back to FIG. 15, on the basis of the measurement result of the electrical characteristic measuring section 282, the peeling judging section 283 judges whether or not the COF 50 is separated from the actuator unit 21, that is, whether or not a check terminal 59 has been peeled off from the corresponding check land 137. When the power consumption of the inverter 296 is less than a predetermined value, the peeling judging section 283 decides that the COF 50 is not separated from the actuator unit 21. When the power consumption of the inverter 296 is more than the predetermined value, the peeling judging section 283 decides that the COF 50 is separated from the actuator unit 21. Further, on the basis of the measurement result of the electrical characteristic measuring section 282, the peeling judging section 283 can also decide the degree of peeling of each check terminal 59 from the corresponding check land 137. Specifically, when the inverter 296 outputs to a check terminal 59 a check pulse signal having its frequency F and its voltage V, the power consumption i of the inverter 296 is expressed by $i=FCV^2$. Thus, the capacitance value C between the check terminal 59 and the common electrode 134 can be calculated from the power consumption i. The capacitance value C changes with the distance of the check terminal 59 from the common electrode 134, that is, with the degree of peeling. Therefore, on the basis of the calculated capacitance value C, the degree of peeling of the check terminal 59 from the corresponding check land 137 can be decided.

Also in this embodiment, like the above-described first embodiment, by setting an appropriate threshold with respect to the power consumption of the inverter 296 to be measured by the electrical characteristic measuring section 282, bonding defect before complete peeling can be detected.

In this embodiment, by a simple method in which the power consumption of the inverter 296 is measured, it can be judged whether or not the COF 50 is separated from the actuator unit 21.

Other Modifications of First to Third Embodiments

Figure 17:
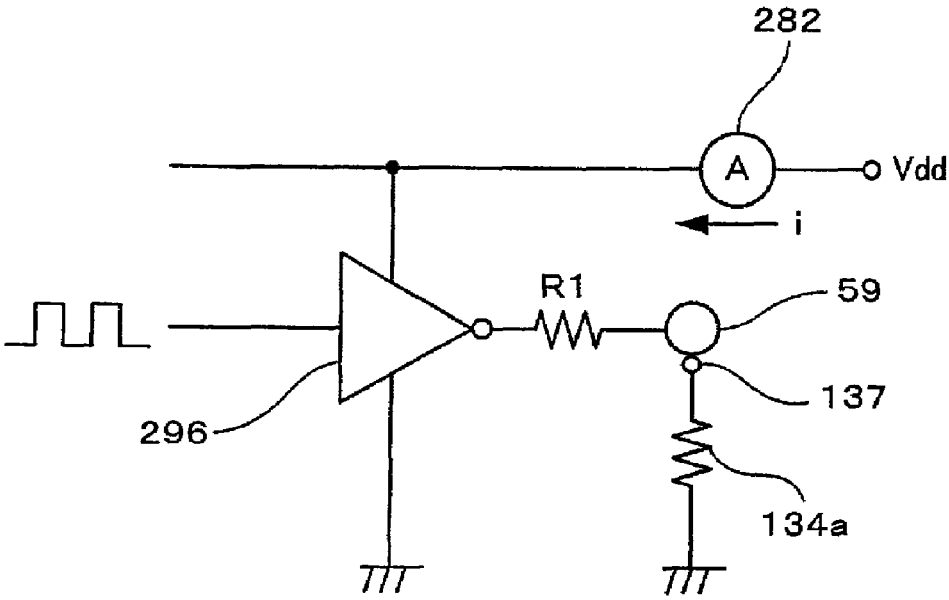
FIG. 17 is a schematic circuit diagram showing an internal construction of an electrical characteristic measuring section according to a modification of the first embodiment of the present invention.

In the above-described first embodiment, by using a combination of two inverters 96 and 97, the condition of the bonding interface is judged from the resistance value between each check terminal 59 and the common electrode 134. In a modification, however, the condition of the bonding interface may be judged on the basis of the power consumption of an inverter, like the third embodiment. For example, as shown in FIG. 17, the inverter 296 is driven to output the high level to each check terminal 59 connected to the common electrode 134 via an internal wire 134*a*. When the bonding is good, a direct current corresponding to the high-level output also flows in the electrical characteristic measuring section 282. When peeling has occurred at the bonding interface, no current flows in the electrical characteristic measuring section 282. When the bonding interface has been damaged, a current corresponding to the resistance value with respect to the check terminal 59 at that time flows in the electrical characteristic measuring section 282. Also in this modification, like the above-described embodiment, by setting an appropriate threshold with respect to the power consumption of the inverter 296 to be measured by the electrical characteristic measuring section 282, bonding defect before complete peeling can be detected.

In the above-described first to third embodiments, two check terminals 59 are disposed on each COF. In a modification, however, only one check terminal may be disposed, or three or more check terminals may be disposed.

The positions of the check terminals are not limited to the positions in the above-described embodiments. In a modification, the check terminals may be disposed at arbitrary positions.

In the above-described first embodiment, on each COF 50, each ground wire 74 is formed between the driver IC 52 and a COM pattern 72, and each check wire 73 is connected to the corresponding ground wire 74 in the vicinity of the driver IC 52. In a modification, however, each COM pattern may be formed at an arbitrary position on the COF. In another modification, each check wire 73 may not be connected to the corresponding ground wire 74.

In the above-described first and second embodiments, each check land 137 is formed on a surface of the piezoelectric layer 141 of each actuator unit 21, and the corresponding check terminal 59 of the corresponding COF 50 is bonded to the check land 137. In a modification, however, each check terminal 59 may be bonded directly to the surface of the piezoelectric layer 141 with an adhesive or the like.

In a modification, the electrical characteristic measuring section may measure another electrical characteristic with respect to each check terminal, which characteristic changes in accordance with whether or not the check terminal is peeled off.

Fourth Embodiment

Next, an inkjet printer according to a fourth embodiment of the present invention will be described with reference to FIGS. 18 to 23. In this embodiment, substantially the same components and functional parts as in the first to third embodiments are denoted by the same references as in the first to third embodiments, respectively, and the description thereof will be omitted.

Figure 18:
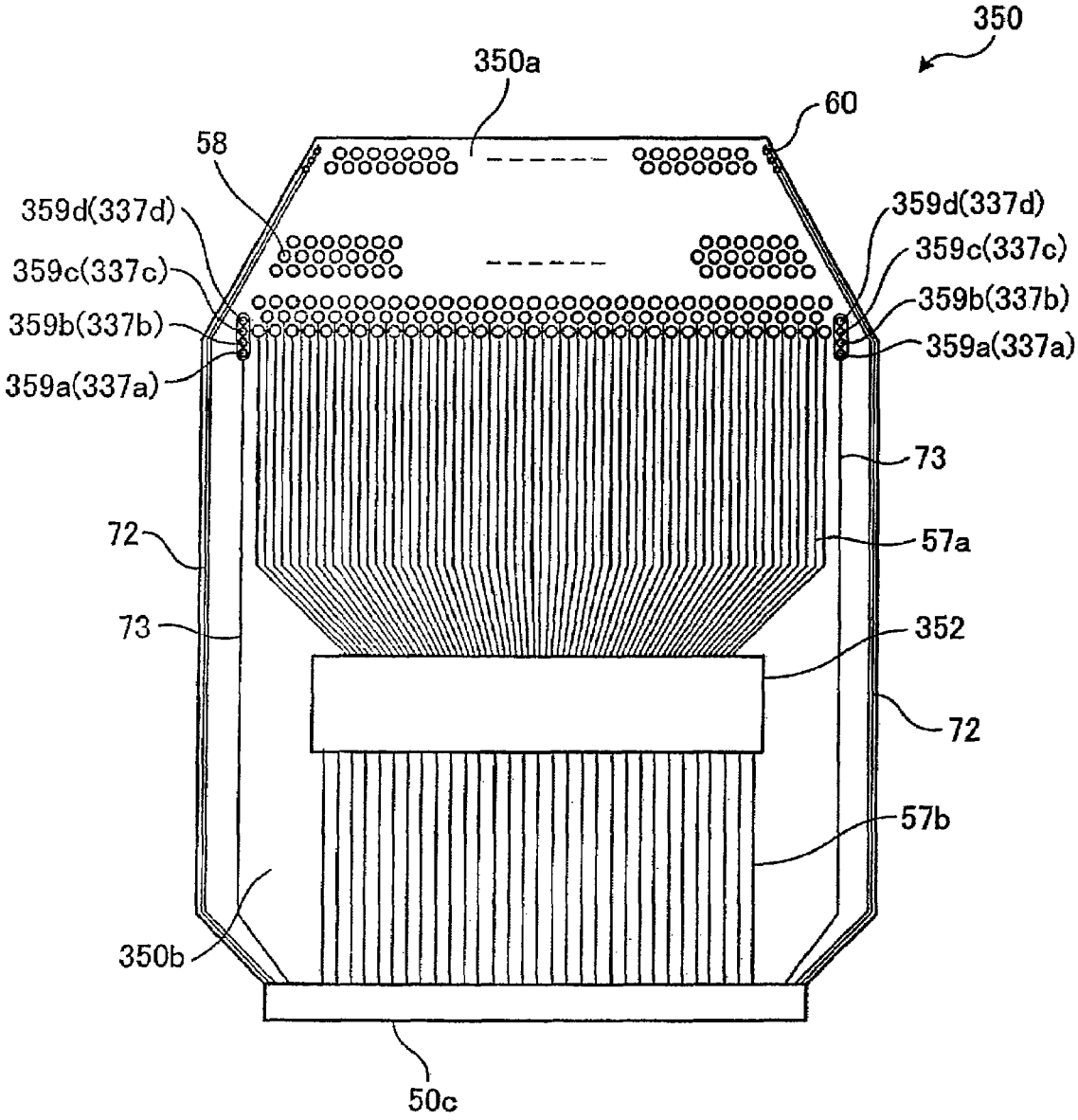
FIG. 18 is a plan view of a COF included in an inkjet printer according to a fourth embodiment of the present invention.
Figure 21:
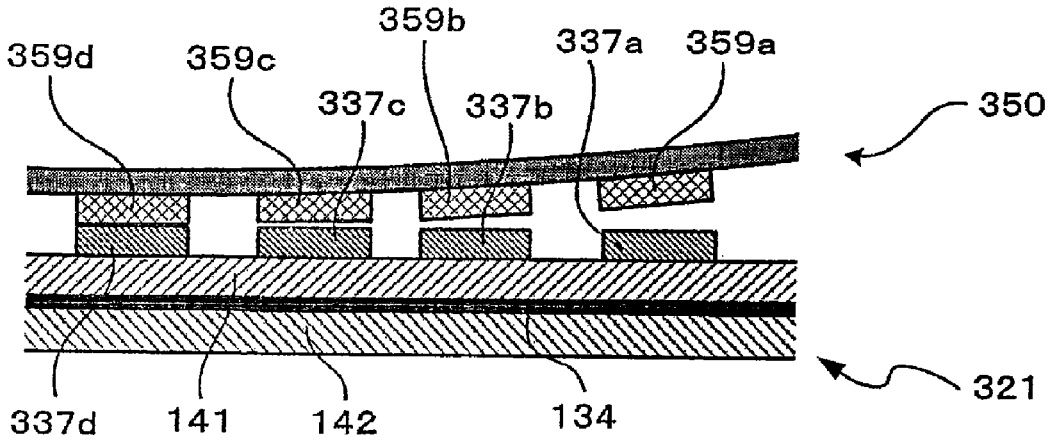
FIG. 21 is a partial sectional view taken along line X-X in FIG. 20A when the COF has separated from an actuator unit.

The inkjet printer of this embodiment has the same construction as the inkjet printer of the first embodiment in the part shown in FIGS. 1 to 5, 6A, and 6B. FIG. 18 is a plan view of a COF 350 included in the inkjet printer of this embodiment. FIG. 18 shows the length of the COF 350 to be shorter than its actual length. As shown in FIG. 18, the COF 350 includes a terminal disposition region 350*a* having substantially the same trapezoidal profile in a plan view as the actuator unit 321 as shown in FIG. 21; a wiring region 350*b* continuous from the long side of the terminal disposition region 350*a*; and a terminal 350*c* disposed at an end of the wiring region 350*b*. The terminal 350*c* is to be connected to the corresponding connector 54*a* of the control substrate 54.

The terminal disposition region 350*a* is fixed to the bonding face of the corresponding actuator unit 321 parallel to the face. On the other hand, the wiring region 350*b* is not fixed to the bonding face of the actuator unit 321. In the terminal disposition region 350*a* disposed are a plurality of output terminals 58 to be bonded to the respective individual lands 136 of the individual electrodes 135; ground terminals 60 to be bonded to not-shown COM lands electrically connected to the common electrode 134; and eight check terminals 359*a* to 359*d* to be respectively bonded to eight check lands 337*a* to 337*d* as shown in FIG. 21. The eight check terminals 359*a* to 359*d* are disposed near both ends of the long side of the terminal disposition region 350*a* in the order of the check terminals 359*a*, 359*b*, 359*c*, and 359*d* in a connection direction from the wiring region 350*b* toward the terminal disposition region 350*a*, in other words, from the long side toward the short side of the terminal disposition region 350*a*. The eight check terminals 359*a* to 359*d* are electrically connected to each other on the COF 350.

In this embodiment, at least one check terminal is positioned closer to the long side than any output terminal 58, and at least one check terminal is disposed so as to be more distant from the long side than the output terminal 58 nearest to the long side. More specifically, of the eight check terminals 359*a* to 359*d*, four check terminals 359*a* and 359*b* nearer to the long side of the terminal disposition region 350*a* are disposed closer to the long side than any output terminal 58. On the other hand, four check terminals 359*c* and 359*d* farther away from the long side of the terminal disposition region 350*a* are disposed so as to be more distant from the output terminals 58 nearest to the long side. Therefore, when the COF 350 has been bonded to the bonding face of the corresponding actuator unit 321, four check terminals 359*a* and 359*b* are disposed near the long side of the actuator unit 321 to be closer to the wiring region 350*b* than any individual electrode 135 while four check terminals 359*c* and 359*d* are positioned near the long side of the actuator unit 321 to be more distant from the long side than the individual electrodes 135 nearest to the long side. In this embodiment, the check terminals 359*a* to 359*d* are at very small distances from the output terminals 58 nearest to them.

A driver IC 352 is mounted at the lateral center of the wiring region 350*b*. In the wiring region 350*b* formed are output wires 57*a* to connect the output terminals 58 to not-shown drive signal terminals of the driver IC 352; control wires 57*b* to connect not-shown control terminals of the driver IC 352 to the terminal 350*c*; and check wires 73 connected to the respective check terminals 359*a* to 359*d*. Near lateral both ends of the COF 350, COM patterns 72 are formed so as to extend along the periphery of the terminal disposition region 350*a* and the wiring region 350*b*. Ground terminals 60 are positioned at the ends of the COM patterns 72 in the terminal disposition region 350*a*.

The terminal 350*c* to be connected to the connector 54*a* of the control substrate 54 has a plurality of not-shown terminals connected to the control wires 57*b* and the COM patterns 72.

Next, the driver IC 352 will be described with reference to FIGS. 19, 20A, 20B, 20C, and 21. FIG. 20A is a partial enlarged plan view of the COF 350 and the actuator unit 321. FIG. 20B is a partial sectional view of the COF 350 and the actuator unit 321 when the COF 350 is not separated from the actuator unit 321. FIG. 20C is a partial sectional view of the COF 350 and the actuator unit 321 when the COF 350 is separated from the actuator unit 321. Each of FIGS. 20B and 20C shows only one check terminal 359*a* of eight check terminal 359*a* to 359*d*. FIG. 21 is a partial sectional view taken along line X-X in FIG. 20A when the COF 350 is separated from the actuator unit 321.

Figure 19:
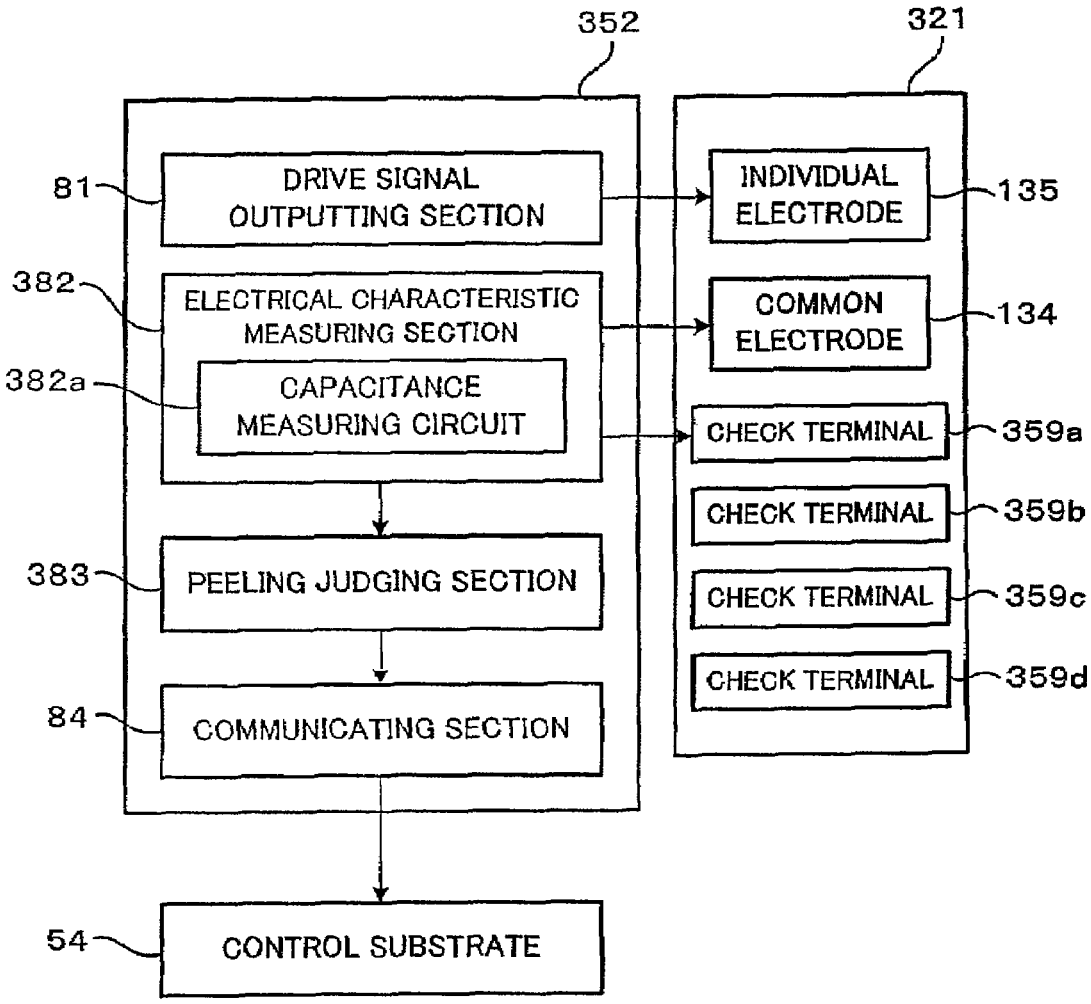
FIG. 19 is a block diagram of a driver IC shown in FIG. 18.
Figure 20A:
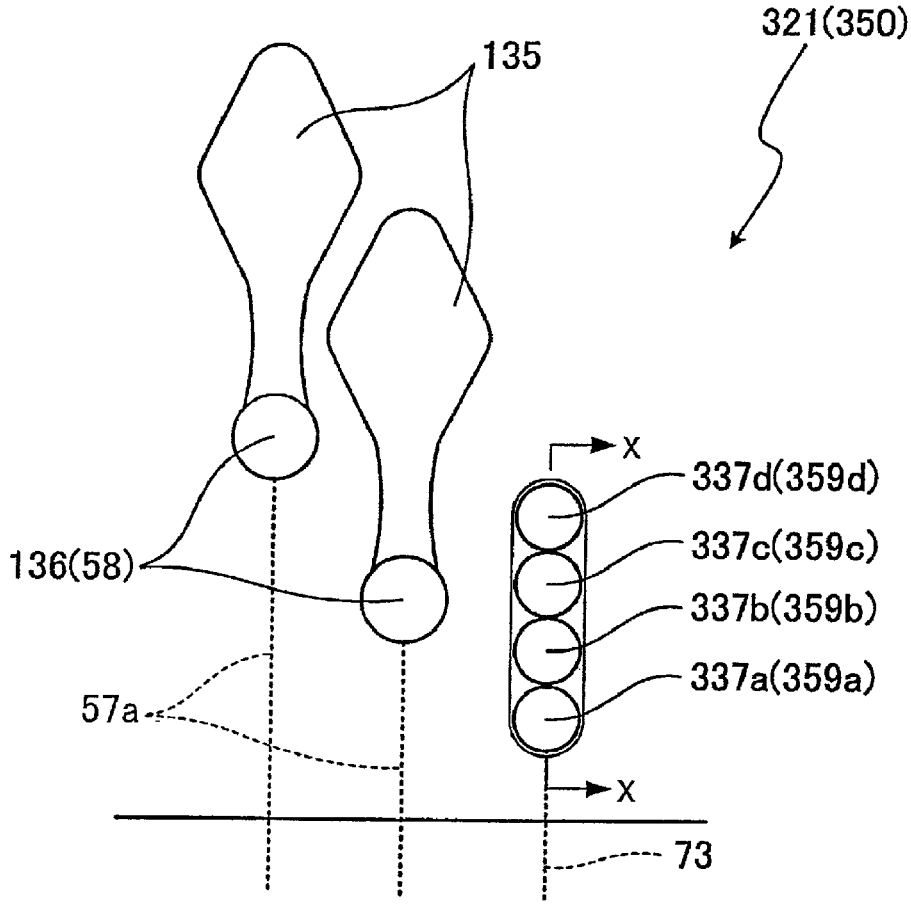
FIGS. 20A, 20B, and 20C show positional relations between check terminals and a common electrode shown in FIG. 19.
Figure 20B:
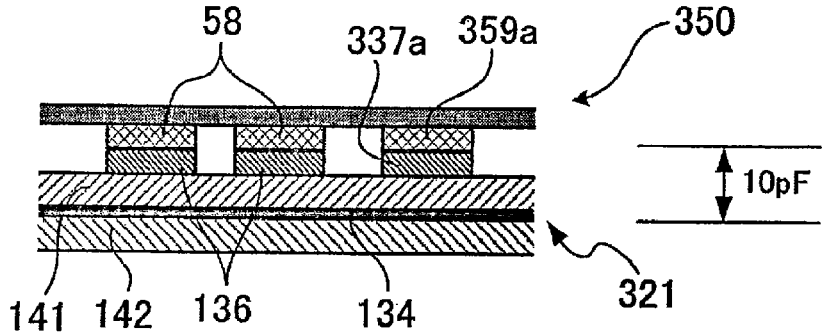
Figure 20C:
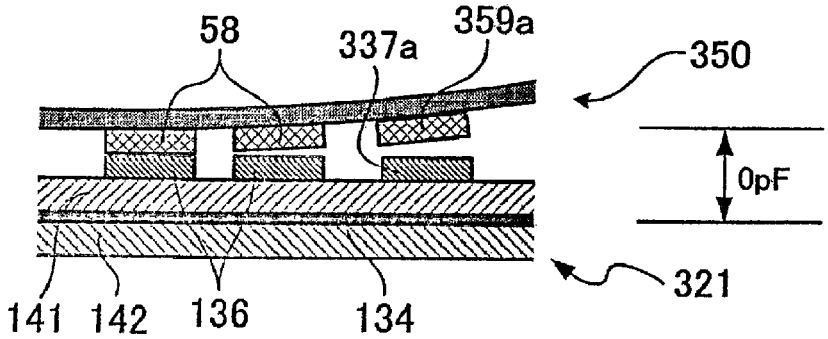

As shown in FIG. 19, the driver IC 352 as a drive signal outputting unit includes a drive signal outputting section 81, an electrical characteristic measuring section 382 as a measuring unit, a peeling judging section 383 as a judging unit, and a communicating section 84. On the basis of an instruction from a not-shown higher-rank apparatus, for example, a host computer, the drive signal outputting section 81 outputs a drive signal to drive the actuator unit 321. The drive signal output from the drive signal outputting section 81 is supplied to target individual electrodes 135 via a drive signal terminal, the corresponding output wires 57*a*, and the corresponding output terminals 58 of the driver IC 352.

In this embodiment, as shown in FIGS. 20B and 20C, the check terminal 359*a* and the check land 337*a* in each pair are electrically insulated from the common electrode 134 by the piezoelectric layer 141. That is, the check terminal 359*a* and the check land 337*a* cooperate with the piezoelectric layer 141 and the common electrode 134 to form a capacitor. When the COF 350 is not separated from the actuator unit 321, the capacitance between the check terminal 359*a* and the common electrode 134 is about 10 pF. As shown in FIG. 20C, when the check terminal 359*a* is peeled off from the check land 337*a*, the check terminal 359*a* gets away from the common electrode 134 to considerably increases the distance between the check terminal 359*a* and the common electrode 134. As a result, the capacitance between the check terminal 359*a* and the common electrode 134 becomes substantially 0 pF. The same applies to the other check terminals 359*b*, 359*c*, and 359*d*.

As shown in FIG. 21, when the COF 350 is separated from the actuator unit 321, four check terminals 359*a* to 359*d* are peeled off from the respectively corresponding check lands 337*a*, 337*b*, 337*c*, and 337*d* in the order from the check terminal 359*a* nearest to the wiring region 350*b*, more specifically, in the order of the check terminals 359*a*, 359*b*, 359*c*, and 359*d*. Thus, the number of check terminals 359*a* to 359*d* having peeled off from the corresponding check lands 337*a* to 337*a* changes in accordance with the degree of separation of the COF 350 from the actuator unit 321. Therefore, the sum of the capacitance values between the four check terminals 359*a* to 359*d* and the common electrode 134 changes in accordance with the degree of separation of the COF 350 from the actuator unit 321. More specifically, when any of the four check terminals 359*a* to 359*d* is not peeled off from the corresponding check lands 337*a* to 337*d*, the sum of the capacitance values is about 10×4=40 pF. When only the check terminal 359*a* is peeled off from the corresponding check land 337*a*, the sum of the capacitance values becomes about 3×10=30 pF. When two check terminals 359*a* and 359*b* are peeled off from the respectively corresponding check lands 337*a* and 337*b*, the sum of the capacitance values becomes about 2×10=20 pF. When three check terminals 359*a* to 359*c* are peeled off from the respectively corresponding check lands 337*a* to 337*c*, the sum of the capacitance values becomes about 1×10=10 pF. When all check terminals 359*a* to 359*d* are peeled off from the respectively corresponding check lands 337*a* to 337*d*, the sum of the capacitance values becomes 0 pF.

The electrical characteristic measuring section 382 measures an electrical characteristic with respect to the check terminals 359*a* to 359*d*. For this purpose, the electrical characteristic measuring section 382 includes therein a capacitance measuring circuit 382*a*. The capacitance measuring circuit 382*a* measures the sum of the capacitance values between the four check terminals 359*a* to 359*d* and the common electrode 134 as the electrical characteristic with respect to the check terminals 359*a* to 359*d*.

Figure 22:
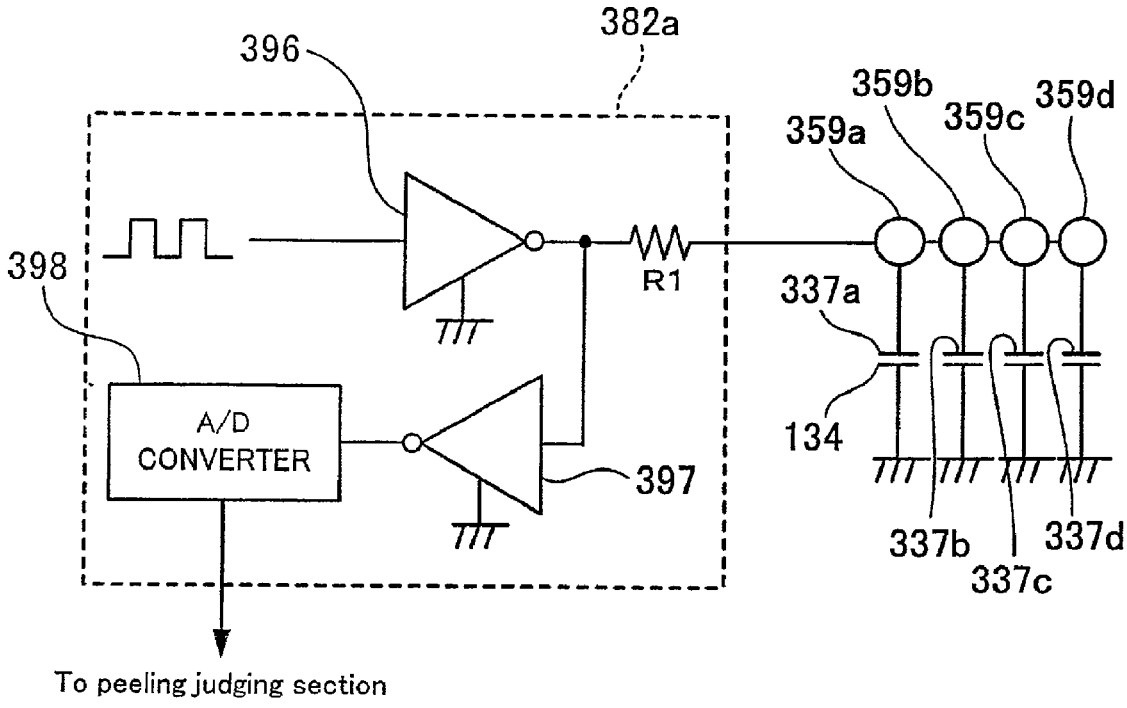
FIG. 22 is a schematic circuit diagram showing an internal construction of a capacitance measuring circuit shown in FIG. 19.

The capacitance measuring circuit 382*a* will be described. FIG. 22 is a schematic circuit diagram showing an internal construction of the capacitance measuring circuit 382*a*. As shown in FIG. 22, the capacitance measuring circuit 382*a* includes a pair of inverters 396 and 397 and an A/D converter 398. When a pulse signal is input, the inverter 396 outputs a check pulse signal to the check terminal 359*a* via a drive resistance R1. The inverter 397 outputs to the A/D converter 398 the check pulse signal sent from the inverter 396. The A/D converter 398 converts the output voltage of the inverter 397 into a digital signal to be output. As described above, when the COF 350 is not separated from the actuator unit 321, the sum of the capacitance values between the four check terminals 359*a* to 359*d* and the common electrode 134 is about 40 pF. As a result, the rise time and fall time of the check pulse signal output from the inverter 396 are longer than those of the input pulse signal. On the other hand, when the check terminals 359*a* to 359*d* are peeled off from the respectively corresponding check lands 337*a* to 337*d* in the order of the check terminals 359*a*, 359*b*, 359*c* and 359*d*, the sum of the capacitance values between the four check terminals 359*a* to 359*d* and the common electrode 134 changes stepwise in the order of 30 pF, 20 pF, 10 pF, and 0 pF. This change in the sum of the capacitance values stepwise shortens the rise time and fall time of the check pulse signal output from the inverter 396. Finally, when the sum of the capacitance values has become 0 pF, the rise time and fall time of the check pulse signal becomes substantially equal to those of the input pulse signal.

Thus, the smaller the sum of the capacitance values, the higher the degree of separation of the COF 350 from the actuator unit 321. In this embodiment, the COF 350 is judged to be separated from the actuator unit 321 when the check terminal 359*c* is peeled off from the check land 337*c*. That is, when the sum of the capacitance values detected is 10 pF, the COF 350 is judged to be separated from the actuator unit 321.

The A/D converter 398 samples the output voltage of the inverter 397 at a timing when a predetermined time has elapsed after the pulse signal input to the inverter 396 rises. At this time, the larger the sum of the capacitance values between the check terminals 359*a* to 359*d* and the common electrode 134, the longer the rise time of the pulse and the lower the sampled output voltage. Conversely, the smaller the sum of the capacitance values between the check terminals 359*a* to 359*d* and the common electrode 134, the shorter the rise time of the pulse and the higher the sampled output voltage. The capacitance measuring circuit 382*a* outputs as a capacitance measurement result a digital signal that indicates the sampled output voltage, to the peeling judging section 383.

On the basis of the measurement result of the capacitance measuring circuit 382*a*, the peeling judging section 383 decides the degree of separation of the COF 350 from the actuator unit 321. That is, on the basis of the sum of the capacitance values between the check terminals 359*a* to 359*d* and the common electrode 134 as the measurement result of the capacitance measuring circuit 382*a*, the peeling judging section 383 decides the number of check terminals 359*a* to 359*d* having been peeled off from the check lands 337*a* to 337*d*. More specifically, when the sum of the capacitance values between the four check terminals 359*a* to 359*d* and the common electrode 134 is 40 pF, the peeling judging section 383 decides that the number of check terminals 359*a* to 359*d* having been peeled off from the check lands 337*a* to 337*d* is zero. When the sum of the capacitance values is 30 pF, the peeling judging section 383 decides that the number of check terminals 359*a* to 359*d* having been peeled off from the check lands 337*a* to 337*d* is one, that is, only the check terminal 359*a* has been peeled off. When the sum of the capacitance values is 20 pF, the peeling judging section 383 decides that the number of check terminals 359*a* to 359*d* having been peeled off from the check lands 337*a* to 337*d* is two, that is, only the check terminals 359*a* and 359*b* have been peeled off. When the sum of the capacitance values is 10 pF, the peeling judging section 383 decides that the number of check terminals 359*a* to 359*d* having been peeled off from the check lands 337*a* to 337*d* is three, that is, only the check terminal 359*a* to 359*c* have been peeled off. When the sum of the capacitance values is 0 pF, the peeling judging section 383 decides that the number of check terminals 359*a* to 359*d* having separated from the check lands 337*a* to 337*d* is four, that is, all the check terminals 359*a* to 359*d* have been peeled off. Such decision is independently made for each set of four check terminals 359*a* to 359*d* disposed near each end of the long side of the terminal disposition region 350*a*.

Figure 23:
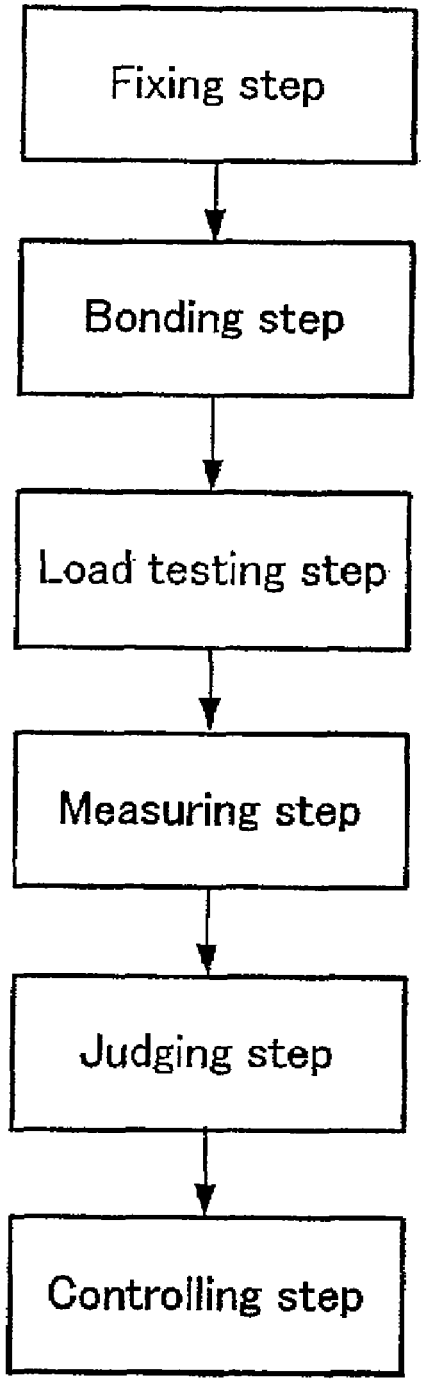
FIG. 23 is a flowchart showing a series of steps of a manufacturing method of an inkjet head.

Next, a manufacturing method of an inkjet head including a checking method of the head according to this embodiment will be described with reference to FIG. 23. FIG. 23 is a flowchart showing a series of steps of the manufacturing method. As shown in FIG. 23, the manufacturing method includes a fixing step, a bonding step, a load testing step, a measuring step, a judging step, and a controlling step. In the fixing step, actuator units 321 are fixed onto a passage unit 9 so that the individual electrodes 135 of the actuator units 321 are opposed to the respective pressure chambers 110 in the passage unit 9, as shown in FIGS. 6A and 6B. In the subsequent bonding step, each COF 350 is bonded to the corresponding actuator unit 321 so that each output terminal 58 is bonded to the corresponding individual land 136; each ground terminal 60 is bonded to the corresponding COM land; and the check terminals 359*a* to 359*d* are bonded to the respectively corresponding check lands 337*a* to 337*d* on the bonding face of the actuator unit 321, as shown in FIG. 20B. In this bonding step, the COF 350 is bonded to the actuator unit 321 under predetermined conditions including the heating temperature, the heating time, and the pressing force upon bonding.

In the load testing step, one inkjet head is selected out of each lot of inkjet heads after completing the fixing and bonding steps, to perform a load test to the selected inkjet head. The load test is a thermal shock test in which the environmental temperature around the inkjet head is rapidly changed to stress the bonding interface between the COF 350 and the actuator unit 321. In the thermal shock test, the inkjet head is placed in a gas-phase test bath, and in this state, the temperature in the test bath is changed. For example, the temperature in the test bath is alternately changed between −40 degrees C. and 100 degrees C. at thirty-minutes intervals. This is repeated in about 200 cycles. In a modification, a liquid-phase test bath may be used in place of the gas-phase test bath. In the modification, the thermal shock test can be completed in a shorter time than that in the gas-phase test bath.

At this time, an accelerated test in which the actuator unit 321 is driven at a high speed may be performed. In the accelerated test, the actuator unit 321 is driven by a higher voltage than the voltage for the normal drive of the actuator unit 321. Because the reliability of the bonding interface between the COF 350 and the actuator unit 321 follows the Arrhenius law and the drive voltage for the actuator unit 321 is high, this increases the quantity or displacement of the actuator unit 321. As a result, the stress on the bonding interface is increased. In addition, the actuator unit 321 may be driven in shorter cycles than those of the normal drive of the actuator unit 321. This increases the number of stresses per unit time applied to the bonding interface. Further, when the interior of the test bath is set in hot and humid conditions, for example, a temperature of 85 degrees C. and a humidity of 85%, this further reduces the time required for the accelerated test. Of the above-described conditions, the optimum ones may be selected in consideration of the required life of the inkjet head and the actual use conditions.

In the measuring step, the COF 350 of the inkjet head after completing the load testing step is connected to the connector 54*a* of the control substrate 54, and in this state, the capacitance measuring circuit 382*a* of the electrical characteristic measuring section 382 measures an electrical characteristic with respect to the check terminals 359*a* to 359*d*, in this embodiment, as described above, the sum of the capacitance values between four check terminals 359*a* to 359*d* and the common electrode 134. In the subsequent judging step, on the basis of the measurement result of the capacitance measuring circuit 382*a*, the peeling judging section 383 decides the number of check terminals 359*a* to 359*d* having been peeled off from the respectively corresponding check lands 337*a* to 337*d*. Thus, the manufacturer can easily grasp the degree of separation of the COF 350 from the actuator unit 321.

In the controlling step, the degree of separation of the COF 350 from the actuator unit 321 is checked. If the result of the check indicates a defective state, the bonding conditions in the above bonding step are revised so as to improve the degree of separation.

The above measuring and judging steps can be performed not only in the manufacturing process of the inkjet head but also regularly or irregularly by instructions of a user even after the inkjet head or an inkjet printer including the inkjet head is shipped. Therefore, even when the COF 350 is completely bonded to the actuator unit 321 at the time of shipping, it can be checked that the COF 350 is gradually separated from the actuator unit 321 due to, for example, a change in temperature with time. Thus, before a nozzle of the inkjet head becomes impossible to eject ink because of the separation of the COF 350 from the actuator unit 321, the user can take measures, for example, request the maker to repair. In the manufacturing method of an inkjet head according to a modification, a check device including therein the above-described electrical characteristic measuring section 382 and peeling judging section 383 may be separately provided to perform the above measuring step and judging step by using the check device. In this modification, each inkjet printer itself may not include the electrical characteristic measuring section and the peeling judging section.

In this embodiment, by a simple method of measuring the sum of the capacitance values between the check terminals 359*a* to 359*d* and the common electrode 134, the manufacturer can easily grasp the degree of separation of the COF 350 from the actuator unit 321 by checking the number of check terminals 359*a* to 359*d* having been peeled off from the respectively corresponding check lands 337*a* to 337*d*. This makes it easy to control the bonding conditions in the bonding step of the manufacturing process of the inkjet head. This improves the yield of inkjet heads. In addition, even after the manufacture of the inkjet head, the inkjet head can be checked and thereby it can easily be judged whether or not there is possibility of separation of the COF 350 from the actuator unit 321 to lead to a trouble. This makes it possible to take proactive measures, for example, replacement of the inkjet head that may lead to a trouble.

In addition, because the electrical characteristic measuring section 382 is only necessary to measure the sum of the capacitance values between the check terminals 359*a* to 359*d* and the common electrode 134, the electrical characteristic measuring section 382 can be realized in a simple circuit construction.

Because four check terminals 359*a* to 359*d* are arranged in the connection direction in the order of the check terminals 359*a*, 359*b*, 359*c* and 359*d*, they are peeled off from the respectively corresponding check lands 337*a* to 337*d* in the order of the check terminals 359*a*, 359*b*, 359*c* and 359*d* when the COF 350 is separated from the actuator unit 321. Thus, by checking the number of check terminals 359*a* to 359*d* having been peeled off from the respectively corresponding check lands 337*a* to 337*d*, the degree of separation of the COF 350 from the actuator unit 321 can be precisely known.

Further, because four check terminals 359*a* and 359*b* in total are positioned closer to the wiring region 350*b* than any output terminal 58, this can efficiently suppress and surely find out separation of the COF 350 from the actuator unit 321.

Further, because four check terminals 359*a* to 359*d* are positioned on either side of the output terminals 58 perpendicular to the connection direction, this can efficiently suppress and surely find out separation of the COF 350 from the actuator unit 321.

In this embodiment, the electrical characteristic measuring section 382 measures the sum of the capacitance values between the check terminals 359*a* to 359*d* and the common electrode 134. In a modification, however, the electrical characteristic measuring section may separately measure the capacitance values between the check terminals 359*a* to 359*d* and the common electrode 134. In this modification, the check terminals 359*a* to 359*d* must be electrically independent of each other on the COF.

<Second Modification>

Figure 24:
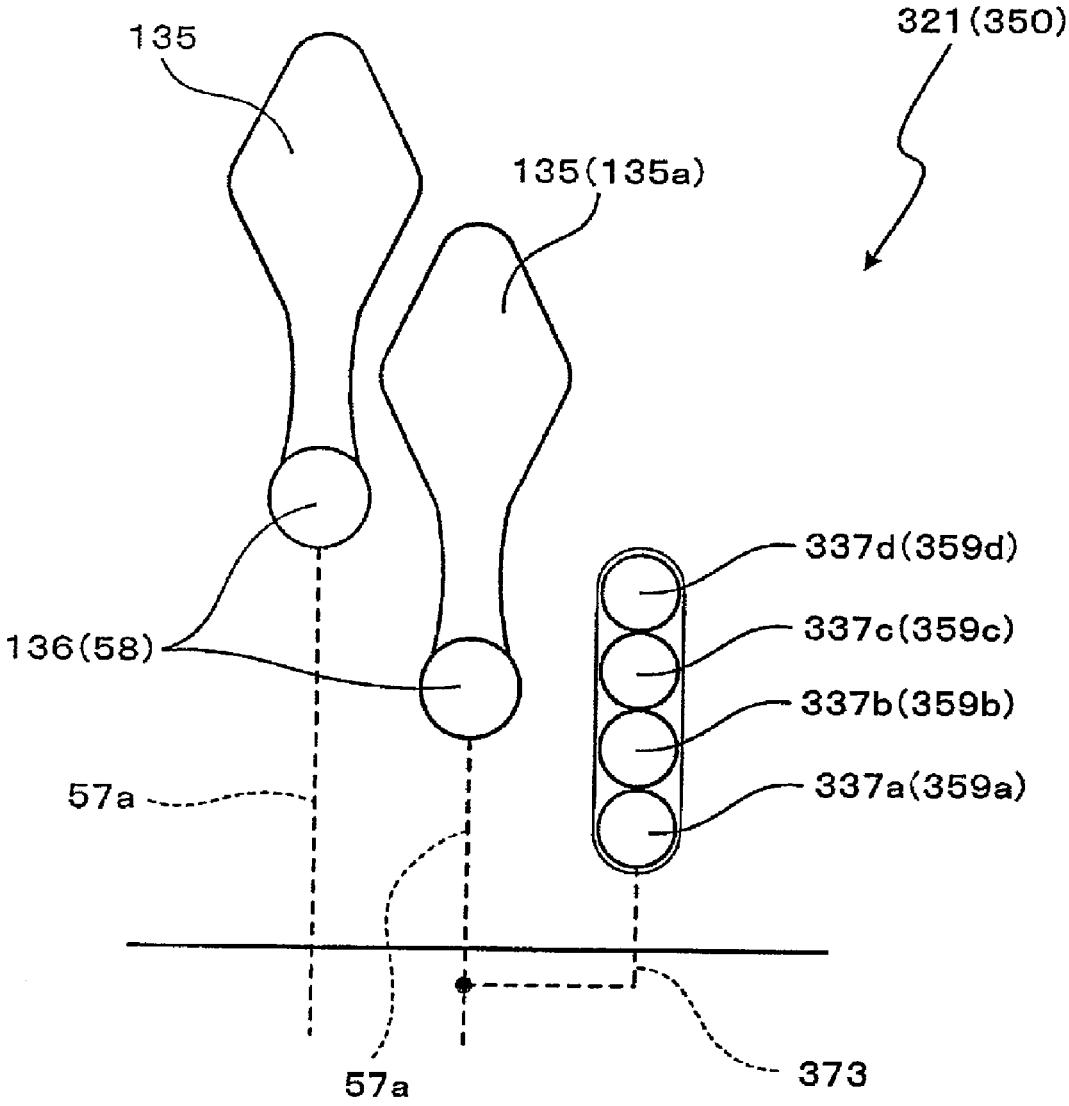
FIG. 24 is a partial enlarged plan view of a COF according to a modification of the fourth embodiment of the present invention.

A modification of the fourth embodiment will be described with reference to FIG. 24. FIG. 24 is a partial enlarged plan view of a COF 350 according to this modification. On the COF 350, as shown in FIG. 24, the check wire 373 connected to the check terminals 359*a* to 359*d* is connected to the output wire 57*a* connected to a check individual electrode 135*a* that is the individual electrode 135 neighboring the check terminals 359*a* to 359*d*. In this manner, the check terminal 359*a* to 359*d* are electrically connected to the check individual electrode 135*a*. The capacitance measuring circuit 382*a* measures the sum of the capacitance values between the common electrode 134 and the check terminals 359*a* to 359*d* and the capacitance value between the common electrode 134 and the check individual electrode 135*a*. As the inverter 396 of the capacitance measuring circuit 382*a*, a part is used of the driving circuit for outputting a drive signal to the check individual electrode 135*a*.

In this modification, because a part of the driving circuit for outputting a drive signal to the check individual electrode 135*a* is used as the inverter 396 of the capacitance measuring circuit 382*a*, this can suppress an increase in the circuit scale of the driver IC 352.

In this modification, in order to equalize the drive characteristics of active portions formed in the piezoelectric layer 141 in accordance with individual electrodes 135 including the check individual electrode 135*a*, the driving circuit for outputting a drive signal to the check individual electrode 135*a* is preferably constructed so that the current value of the drive signal to be output to the check individual electrode 135*a* is larger than the current value of the drive signal to be output to any other individual electrode 135 than the check individual electrode 135*a*. For this purpose, for example, the ON resistance of a transistor in the driving circuit for outputting a drive signal to the check individual electrode 135*a* is set to be lower than that of any other driving circuit. This can suppress variation in the drive characteristics of the active portions.

Fifth Embodiment

Figure 25:
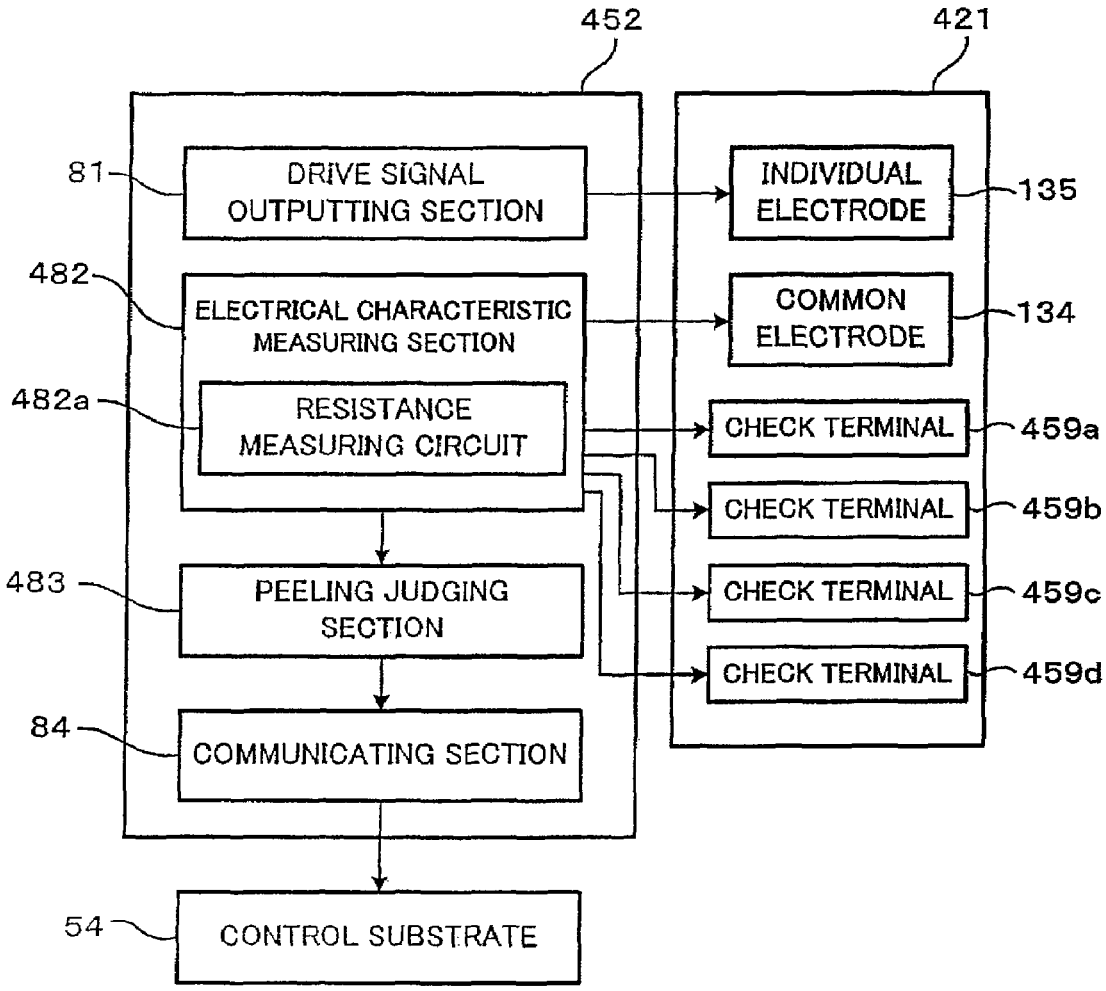
FIG. 25 is a block diagram of a driver IC included in an inkjet printer according to a fifth embodiment of the present invention.
Figure 26A:
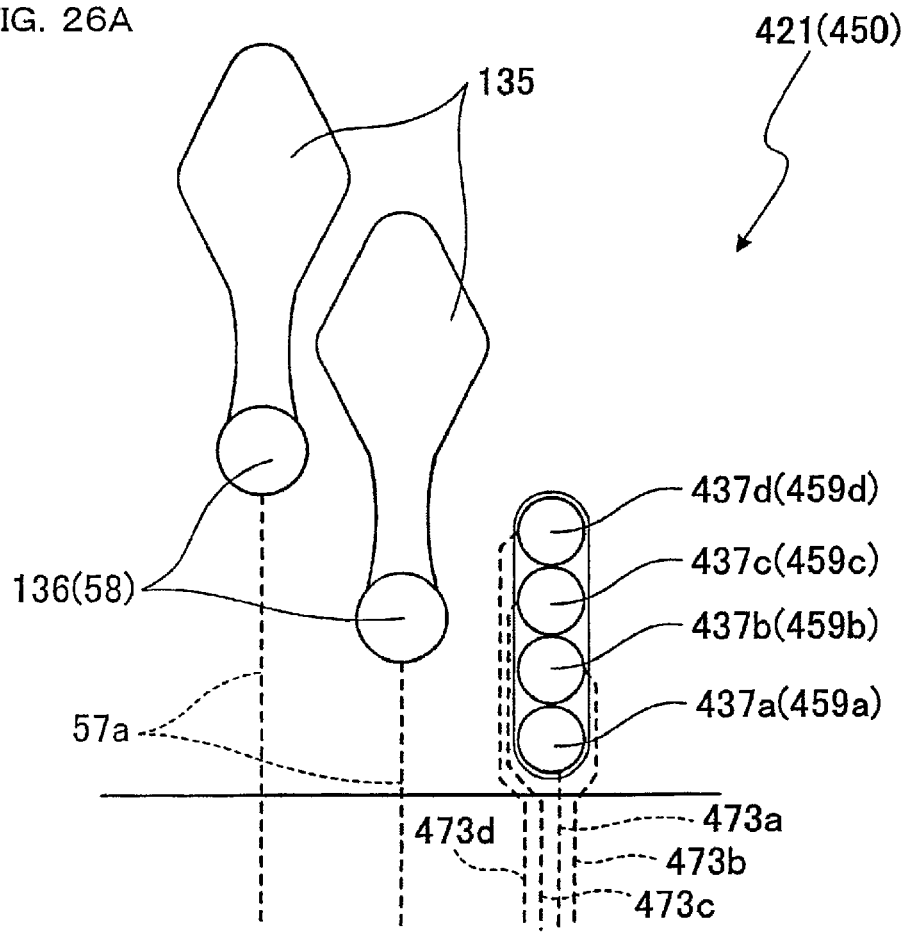
FIGS. 26A, 26B, and 26C show positional relations between check terminals and a common electrode shown in FIG. 25.
Figure 26B:
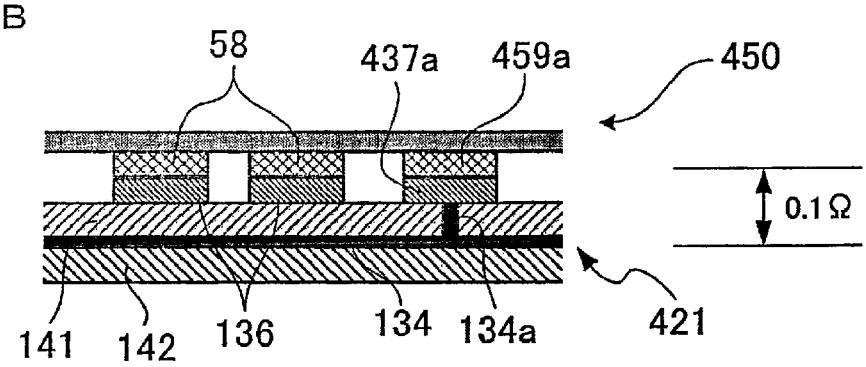
Figure 26C:
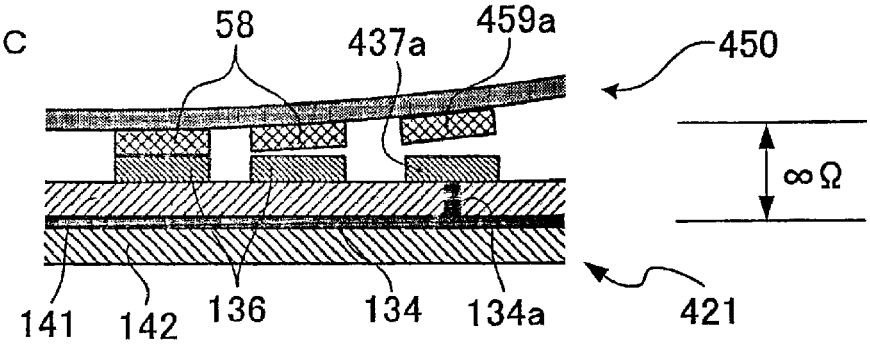

Next, an inkjet printer according to a fifth embodiment of the present invention will be described. In this embodiment, substantially the same components and functional parts as in the first to fourth embodiments are denoted by the same references as in the first to fourth embodiments, respectively, and the description thereof will be omitted. FIG. 25 is a block diagram of a driver IC 452 included in the inkjet printer of this embodiment. FIG. 26A is a partial enlarged plan view of a COF 450 and an actuator unit 421. FIG. 26B is a partial sectional view of the COF 450 and the actuator unit 421 when the COF 450 is not separated from the actuator unit 421. FIG. 26C is a partial sectional view of the COF 450 and the actuator unit 421 when the COF 450 is separated from the actuator unit 421. FIGS. 26B and 26C show only one check terminal 459*a* of eight check terminals 459*a* to 459*d*. As shown in FIG. 25, the driver IC 452 includes a drive signal outputting section 81, an electrical characteristic measuring section 482 as a measuring unit, a peeling judging section 483 as a judging unit, and a communicating section 84.

As shown in FIG. 25 and 26A, check wires 473*a* to 473*d* connected to the respectively corresponding check terminals 459*a* to 459*d* are formed on the COF 450. The check wires 473*a* to 473*d* are connected to the driver IC 452 independently of each other.

In this embodiment, at least one check terminal is positioned closer to the long side than any output terminal 58, and at least one check terminal is positioned so as to be more distant from the long side than the output terminal 58 nearest to the long side. More specifically, of the eight check terminals 459*a* to 459*d*, four check terminals 459*a* and 459*b* nearer to the long side of the terminal disposition region are positioned closer to the long side than any output terminal 58. On the other hand, four check terminals 459*c* and 459*d* farther away from the long side of the terminal disposition region are positioned so as to be more distant from the output terminals 58 nearest to the long side.

As shown in FIGS. 26B and 26C, internal wires 134*a* are formed through the thickness of the piezoelectric layer 141 so as to connect the check lands 437*a* to 437*d* to the common electrode 134. Thus, when the COF 450 is not separated from the actuator unit 421, the check terminals 459*a* to 459*d* are electrically connected to the common electrode 134 via the respectively corresponding check lands 437*a* to 437*d* and internal wires 134*a*. In this state, the resistance value between the check terminal 459*a* and the common electrode 134 is about 0.1 ohm. In this embodiment, the check terminals 459*a* to 459*d* are at very small distances from the output terminal 58 nearest to the check terminals 459*a* to 459*d*. Therefore, when any output terminal 58 has not been peeled off from the corresponding individual land 136, the check terminal 459*a* to 459*d* may also have not been peeled off from the respectively corresponding check lands 437*a* to 437*d*.

When the COF 450 is separated from the actuator unit 421, four check terminals 459*a* to 459*d* are peeled off from the respectively corresponding check lands 437*a* to 437*d* in the order from the check terminal 459*a* nearest to the wiring region, more specifically, in the order of the check terminals 459*a*, 459*b*, 459*c*, and 459*d*. As shown in FIG. 26C, when the check terminal 459*a* is peeled off from the corresponding check land 437*a*, the resistance value between the check terminal 459*a* and the common electrode 134 becomes infinite ohm. Thus, the number of check terminals 459*a* to 459*d* in which the resistance values between them and the common electrode 134 become infinite ohm changes in accordance with the degree of separation of the COF 350 from the actuator unit 421, as shown in FIG. 21.

The electrical characteristic measuring section 482 measures an electrical characteristic with respect to the check terminals 459*a* to 459*d*. For this purpose, the electrical characteristic measuring section 482 includes therein a resistance measuring circuit 482*a*. The resistance measuring circuit 482*a* measures the resistance values between the four check terminals 459*a* to 459*d* and the common electrode 134 as the electrical characteristic with respect to the check terminals 459*a* to 459*d*.

Figure 27:
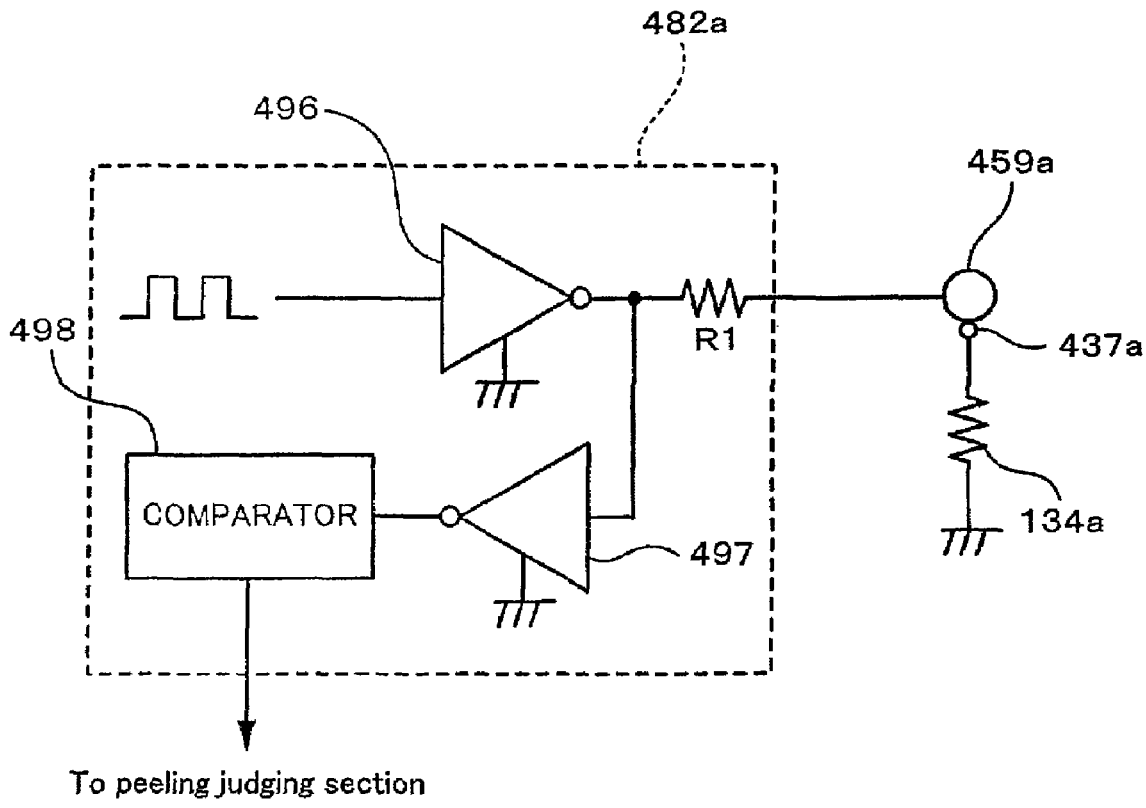
FIG. 27 is a schematic circuit diagram showing an internal construction of a resistance measuring circuit shown in FIG. 25.

The resistance measuring circuit 482*a* will be described. FIG. 27 is a schematic circuit diagram showing an internal construction of the resistance measuring circuit 482*a*. FIG. 27 shows only an circuit construction for measuring the resistance value between the check terminal 459*a* and the common electrode 134. Any circuit construction for measuring the resistance values between the other check terminals 459*b* to 459*d* and the common electrode 134 is substantially the same as the circuit construction shown in FIG. 27. The resistance measuring circuit 482*a* includes a pair of inverters 496 and 497 and a comparator 498. When a pulse train signal is input, the inverter 496 outputs a check signal to the check terminal 459*a* via a drive resistance R1. The inverter 497 outputs to the comparator 498 the check signal sent from the inverter 496. The comparator 498 compares the output voltage from the inverter 497 with a high-level reference voltage. As described above, when the COF 450 is not separated from the actuator unit 421, the resistance value between the check terminal 459*a* and the common electrode 134 is about 0.1 ohm. In this state, therefore, the output voltage of the inverter 496 is always low while the output voltage of the inverter 497 is always high. On the other hand, when the COF 450 is separated from the actuator unit 421, the resistance value between the check terminal 459*a* and the common electrode 134 becomes infinite ohm because the check terminal 459*a* has been peeled off from the corresponding check land 437*a*. In this case, the output voltage of the inverter 496 changes between high and low levels in accordance with the input pulse train signal, and the output voltage of the inverter 497 also changes between high and low levels.

When the output voltage of the inverter 497 corresponds to the reference voltage as both are at high level, the comparator 498 outputs to the peeling judging section 483 a measurement result indicating that the resistance value between the check terminal 459*a* and the common electrode 134 is about 0.1 ohm. When the output of the inverter 497 does not correspond to the reference voltage, that is, when the output of the inverter 497 has once become low level, the comparator 498 outputs to the peeling judging section 483 a measurement result indicating that the resistance value between the check terminal 459*a* and the common electrode 134 is infinite ohm. As for each of the other check terminals 459*b* to 459*d*, the electrical characteristic measuring section 482 measures the resistance value between the check terminal and the common electrode with the same circuit construction, and outputs the measurement result to the peeling judging section 483.

On the basis of the measurement result of the resistance measuring circuit 482*a*, the peeling judging section 483 decides the degree of separation of the COF 450 from the actuator unit 421. That is, on the basis of resistance values as the measurement result of the resistance measuring circuit 482*a*, the peeling judging section 483 decides the number of check terminals 459*a* to 459*d* having been peeled off from the respectively corresponding check lands 437*a* to 437*d*. More specifically, when any resistance value as the measurement result of the resistance measuring circuit 482*a* is about 0.1 ohm, the peeling judging section 483 decides that any of the check terminals 459*a* to 459*d* has not been peeled off from the respectively corresponding check lands 437*a* to 437*d*. When any resistance value is infinite ohm, the peeling judging section 483 decides that all the check terminals 459*a* to 459*d* have been peeled off from the respectively corresponding check lands 437*a* to 437*d*. When only the resistance value with respect to the check terminal 459*a* is infinite ohm and the remaining three resistance values are about 0.1 ohm, the peeling judging section 483 decides that only the check terminal 459*s* has been peeled off from the corresponding check land 437*a*. The peeling judging section 483 thus decides the number of check terminals 459*a* to 459*d* having been peeled off from the respectively corresponding check lands 437*a* to 437*d*.

In the above-described case, the resistance value is infinite ohm when each check terminal has been peeled off from the corresponding check land. However, when an external force is applied to the bonding interface between the check terminal and the check land, the force may bring about damage on the bonding interface causing partial peeling. In this case, the resistance value becomes higher than 0.1 ohm in accordance with the degree of the damage on the bonding interface. Judgment of the peeling judging section 483 in this case is the same as the judgment described in the first embodiment.

The inkjet head of this embodiment can be manufactured by substantially the same method as that described in the fourth embodiment. Therefore, the description of the manufacturing method of the inkjet head of this embodiment is omitted here.

In this embodiment, by a simple method of measuring the resistance values between the respective check terminals 459*a* to 459*d* and the common electrode 134, the manufacturer can easily grasp the degree of separation of the COF 450 from the actuator unit 421 by checking the number of check terminals 459*a* to 459*d* having been peeled off from the respectively corresponding check lands 437*a* to 437*d*. This makes it easy to control the bonding conditions in the bonding step of the manufacturing process of the inkjet head. This improves the yield of inkjet heads. In addition, even after the manufacture of the inkjet head, a user can easily check the inkjet head to judge whether or not there is possibility of separation of the COF 450 from the actuator unit 421 to lead to a trouble. This makes it possible to take proactive measures, for example, replacement of the inkjet head that may lead to a trouble.

In this embodiment, the check lands 437*a* to 437*d* are electrically connected to the common electrode 134. In a modification, however, the check lands 437*a* to 437*d* may be electrically connected to the passage unit 9 as a metallic member. This can realize the electrical characteristic measuring section as a measuring unit by a simple construction. In this modification, the passage unit 9 is preferably put at the ground potential via a not-shown frame or the like.

Sixth Embodiment

Figure 28:
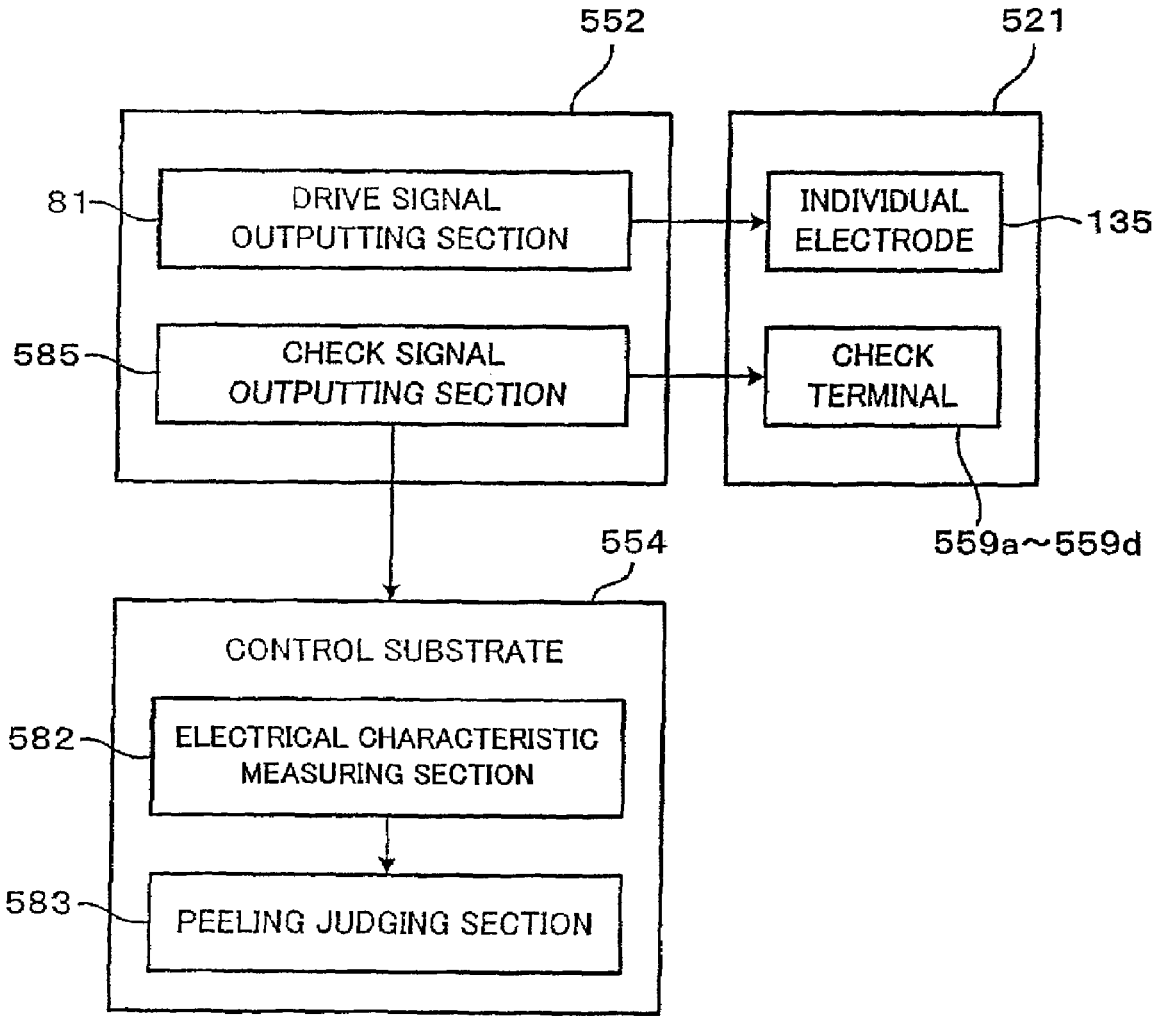
FIG. 28 is a block diagram of a driver IC included in an inkjet printer according to a sixth embodiment of the present invention.

Next, an inkjet printer according to a sixth embodiment of the present invention will be described. In this embodiment, substantially the same components and functional parts as in the first to fifth embodiments are denoted by the same references as in the first to fifth embodiments, respectively, and the description thereof will be omitted. FIG. 28 is a block diagram showing functional constructions of a driver IC 552 and a control substrate 554 included in the inkjet printer of this embodiment. As shown in FIG. 28, the driver IC 552 includes a drive signal outputting section 81 and a check signal outputting section 585. The control substrate 554 includes an electrical characteristic measuring section 582 as a measuring unit and a peeling judging section 583 as a judging unit.

Figure 29:
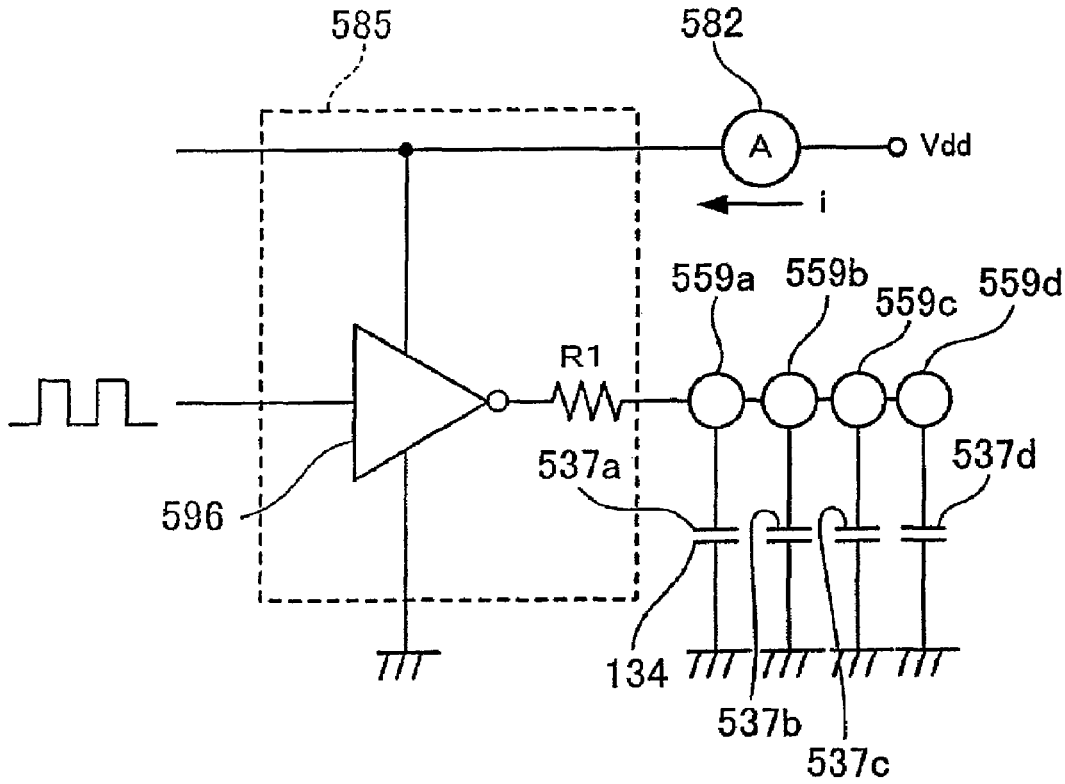
FIG. 29 is a schematic circuit diagram showing an internal construction of a check signal outputting section and an electrical characteristic measuring section shown in FIG. 28.

The check signal outputting section 585 and the electrical characteristic measuring section 582 will be described with reference to FIG. 29. FIG. 29 is a schematic circuit diagram showing internal constructions of the check signal outputting section 585 and the electrical characteristic measuring section 582. As shown in FIG. 29, the check signal outputting section 585 includes an inverter 596 that receives a pulse signal and thereby outputs a check pulse signal to four check terminals 559*a* to 559*d* via a drive resistance R1. The electrical characteristic measuring section 582 is for measuring an electrical characteristic with respect to the check terminals 559*a* to 559*d*. In this embodiment, the electrical characteristic measuring section 582 measures the power consumption of the inverter 596 when the inverter 596 outputs to the check terminals 559*a* to 559*d* a check pulse signal having its frequency F and its voltage V. The electrical characteristic measuring section 582 outputs its measurement result to the peeling judging section 583.

On the basis of the power consumption i of the inverter 596 as the measurement result of the electrical characteristic measuring section 582, the peeling judging section 583 decides the degree of separation of the COF from the actuator unit 521, that is, the number of check terminals 559*a* to 559*d* having been peeled off from the respectively corresponding check lands 537*a* to 537*d*. This decision is made for each set of four check terminals 559*a* to 559*d* positioned near each end with respect to the long side of the terminal disposition region. When the inverter 596 outputs to the check terminals 559*a* to 559*d* a check pulse signal having its frequency F and its voltage V, the power consumption i of the inverter 596 is expressed by $i=FCV^2$. On the basis of the expression, the peeling judging section 583 calculates the capacitance values C between the four check terminals 559*a* to 559*d* and the common electrode 134. As described above, when the check terminals 559*a* to 559*d* are peeled off from the respectively corresponding check lands 537*a* to 537*d* in the order of the check terminals 559*a*, 559*b*, 559*c*, and 559*d* as the COF is separated from the actuator unit 521, the sum of the capacitance values between the four check terminals 559*a* to 559*d* and the common electrode 134 changes in the order of 30 pF, 20 pF, 10 pF, and 0 pF. Thus, on the basis of the calculated capacitance values C, the peeling judging section 583 can decide the number of check terminals 559*a* to 559*d* having been peeled off from the respectively corresponding check lands 537*a* to 537*d*.

Also in this embodiment, like the above-described fifth embodiment, by setting an appropriate threshold with respect to the power consumption of the inverter 596 to be measured by the electrical characteristic measuring section 582, bonding defect before complete peeling can be detected.

The inkjet head of this embodiment can be manufactured by substantially the same method as that described in the fourth embodiment. Therefore, the description of the manufacturing method of the inkjet head of this embodiment is omitted here.

In this embodiment, by a simple method of measuring the power consumption of the inverter 596, the manufacturer can easily grasp the degree of separation of the COF from the actuator unit 521 by checking the number of check terminals 559*a* to 559*d* having been peeled off from the respectively corresponding check lands 537*a* to 537*d*. This makes it easy to control the bonding conditions in the bonding step of the manufacturing process of the inkjet head. This improves the yield of inkjet heads. In addition, even after the manufacture of the inkjet head, the manufacturer or a user can easily check the inkjet head to judge whether or not there is possibility of separation of the COF from the actuator unit 521 to lead to a trouble. This makes it possible to take proactive measures, for example, replacement of the inkjet head that may lead to a trouble.

Other Modifications of Fourth to Sixth Embodiments

Figure 30:
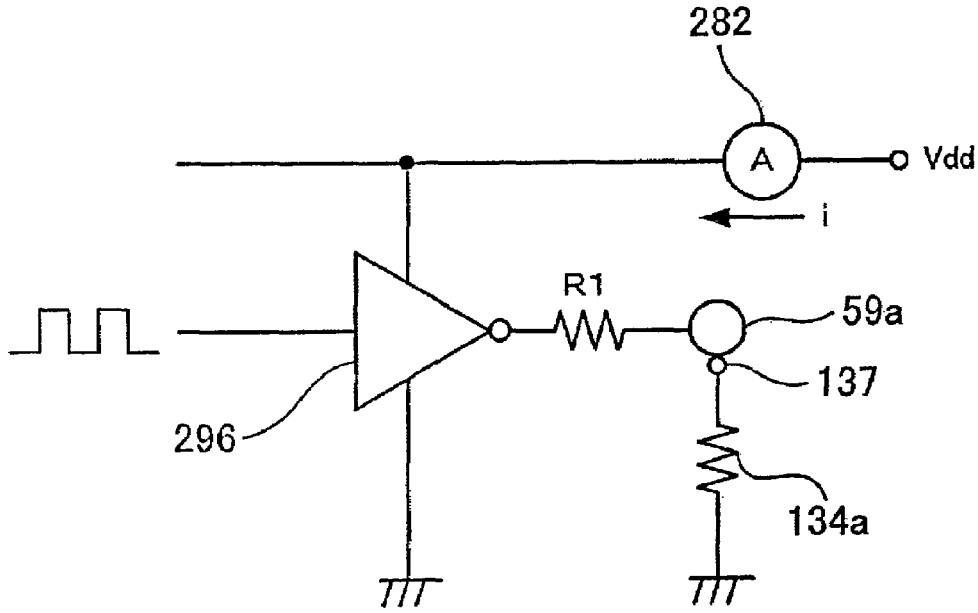
FIG. 30 is a schematic circuit diagram showing an internal construction of an electrical characteristic measuring section according to a modification of the sixth embodiment of the present invention.

In the above-described firth embodiment, by using a combination of two inverters 496 and 497, the degree of separation is judged from the resistance values between the check terminals 459*a* to 459*d* and the common electrode 134. In a modification, however, the degree of separation may be judged on the basis of the power consumption of an inverter, like the sixth embodiment. For example, as shown in FIG. 30, the inverter 296 is driven to output the high level to the check terminal 59*a* connected to the common electrode 134 via an internal wire 134*a*. When the bonding condition is good, a direct current corresponding to the high-level output also flows in the electrical characteristic measuring section 282. When peeling has occurred at the bonding interface, no current flows in the electrical characteristic measuring section 282. When the bonding interface has been damaged, a current corresponding to the resistance values with respect to the check terminals 59*a* to 59*d* at that time flows in the electrical characteristic measuring section 282. Also in this modification, like the above-described embodiment, by setting an appropriate threshold with respect to the power consumption of the inverter 296 to be measured by the electrical characteristic measuring section 282, bonding defect before complete peeling can be detected.

In the above-described fourth and fifth embodiments, four check terminals 559*a* to 559*d* are arranged in the order of the check terminals 559*a*, 559*b*, 559*c*, and 559*d* in the direction from the long side toward the short side of the terminal disposition region continuous from the wiring region. In a modification, however, these check terminals may be positioned at arbitrary positions as far as they are within the region of the COF to be bonded to the actuator unit. In addition, the number of check terminals is arbitrary as far as it is more than one.

In a modification, the check terminals may be bonded directly to the surface of the piezoelectric layer 141 with an adhesive or the like.

In a modification, the electrical characteristic measuring section may measure another electrical characteristic with respect to each check terminal, which characteristic changes in accordance with whether or not the check terminal is peeled off. In a modification, after each actuator unit on which their individual electrodes have not yet been formed is fixed to the passage unit, the individual electrodes and individual lands may be formed on the actuator unit.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet recording apparatus comprising:

a passage unit in which formed are a plurality of individual ink passages each leading to a nozzle via a pressure chamber;

an actuator unit fixed to the passage unit, the actuator unit comprising a plurality of individual electrodes related to the respective pressure chambers, a common electrode, a piezoelectric layer interposed between the plurality of individual electrodes and the common electrode, and a plurality of individual lands positioned on a bonding face of the actuator unit opposite from a fixing face of the actuator unit fixed to the passage unit, the plurality of individual lands being electrically connected to the respective individual electrodes;

a flat flexible substrate comprising a plurality of output terminals bonded to the respective individual lands, and a check terminal bonded to the bonding face of the actuator unit;

a drive signal outputting unit which outputs drive signals to be supplied to the plurality of individual electrodes via the plurality of output terminals;

a measuring unit which measures an electrical characteristic with respect to the check terminal; and a judging unit which judges, on the basis of a measurement result of the measuring unit, whether or not the check terminal has been peeled off from the bonding face of the actuator unit.

2. The apparatus according to claim 1, wherein the measuring unit measures the capacitance between the common electrode and the check terminal.

3. The apparatus according to claim 1, wherein the check terminal is electrically connected to a check individual electrode which is one of the plurality of individual electrode, and the measuring unit measures the sum of the capacitance value between the common electrode and the check terminal and the capacitance value between the common electrode and the check individual electrode.

4. The apparatus according to claim 3, wherein the current value of the drive signal to be output from the drive signal outputting unit to the check individual electrode is larger than the current value of the drive signal to be output from the drive signal outputting unit to any other individual electrode than the check individual electrode, so as to equalize the driving characteristics of a plurality of active portions formed in the piezoelectric layer to respectively correspond to the plurality of individual electrodes.

5. The apparatus according to claim 1, wherein the actuator unit further comprises a check land positioned on the bonding face of the actuator unit to be electrically connected to the common electrode, the check terminal is bonded to the bonding face of the actuator unit through the check land, and the measuring unit measures the resistance between the common electrode and the check terminal.

6. The apparatus according to claim 1, wherein the passage unit comprises a metallic member, the actuator unit further comprises a check land positioned on the bonding face of the actuator unit to be electrically connected to the metallic member, the check terminal is bonded to the bonding face of the actuator unit through the check land, and the measuring unit measures the resistance between the metallic member and the check terminal.

7. The apparatus according to claim 1, wherein the drive signal outputting unit is attached to the lateral center of the flat flexible substrate, a drive signal reference potential pattern put at a reference potential with respect to the drive signals is formed to extend near and along the each lateral end of the flat flexible substrate, a control signal reference potential pattern put at a reference signal with respect to a control signal to control the drive signal outputting unit is formed between the drive signal outputting unit and the drive signal reference potential pattern, and the check terminal is electrically connected to the control signal reference potential pattern.

8. The apparatus according to claim 1, wherein the measuring unit measures an electrical characteristic with respect to the check terminal on the basis of the power consumption when a check signal is supplied to the check terminal.

9. The apparatus according to claim 1, wherein the flat flexible substrate is composed of a terminal disposition region in which formed are the plurality of output terminals and the check terminal, the terminal disposition region being fixed to the bonding face of the actuator unit, and a wiring region in which formed are a plurality of wires each connected to the output terminal or the check terminal, the wiring region being not fixed to the bonding face of the actuator unit, and the check terminal is positioned closer to the wiring region than any of the plurality of individual electrodes.

10. A manufacturing method of an inkjet head, the method comprising:

a fixing step of fixing an actuator unit comprising a plurality of individual electrodes, a common electrode, a piezoelectric layer interposed between the plurality of individual electrodes and the common electrode, and a plurality of individual lands electrically connected to the respective individual electrodes, to a passage unit in which formed are a plurality of individual ink passages each leading to a nozzle via a pressure chamber, so that the plurality of individual electrodes are opposed to the respective pressure chambers;

a bonding step of bonding to the actuator unit a flat flexible substrate comprising a plurality of output terminals and a plurality of check terminals, so that the plurality of check terminals are bonded to a bonding face of the actuator unit opposite from a fixing face of the actuator unit fixed to the passage unit, and the plurality of individual lands are bonded to the respective output terminals;

a measuring step of measuring an electrical characteristic with respect to the plurality of check terminals bonded to the bonding face of the actuator unit; and a judging step of deciding, on the basis of a measurement result in the measuring step, the number of check terminals having been peeled off from the bonding face of the actuator unit.

11. The method according to claim 10, wherein the capacitance between the common electrode and each check terminal is measured in the measuring step.

12. The method according to claim 10, wherein the check terminals are electrically connected to a check individual electrode which is one of the plurality of individual electrode, and the sum of the capacitance values between the common electrode and the check terminals and the capacitance value between the common electrode and the check individual electrode is measured in the measuring step.

13. The method according to claim 10, wherein the actuator unit further comprises check lands positioned on the bonding face of the actuator unit to be electrically connected to the common electrode, the check terminals are bonded to the bonding face of the actuator unit through the respective check lands in the bonding step, and the resistance values between the common electrode and the respective check terminals are measured in the measuring step.

14. The method according to claim 10, wherein the passage unit comprises a metallic member, the actuator unit further comprises check lands positioned on the bonding face of the actuator unit, the actuator unit is fixed to the passage unit in the fixing step so that the check lands are electrically connected to the metallic member, the check terminals are bonded to the bonding face of the actuator unit through the respective check lands in the bonding step, and the resistance values between the metallic member and the respective check terminals are measured in the measuring step.

15. The method according to claim 10, wherein an electrical characteristic with respect to the check terminals is measured in the measuring step on the basis of the power consumption when a check signal is supplied to the check terminals.

16. The method according to claim 10, wherein the flat flexible substrate being composed of a terminal disposition region in which formed are the plurality of output terminals and the plurality of check terminals, and a wiring region in which formed are a plurality of wires each connected to the output terminal or the check terminal, is bonded to the actuator unit in the bonding step so that the terminal disposition region of the flat flexible substrate is fixed to the bonding face of the actuator unit and the wiring region of the flat flexible substrate is not fixed to the bonding face of the actuator unit, and the plurality of check terminals are arranged in a connection direction from the wiring region toward the terminal disposition region.

17. The method according to claim 16, wherein at least one of the plurality of check terminals is positioned closer to the wiring region than any of the plurality of output terminals.

18. The method according to claim 16, wherein the plurality of check terminals are positioned on both sides of the plurality of output terminals perpendicularly to the connection direction.

19. A checking method of an inkjet head comprising a passage unit in which formed are a plurality of individual ink passages each leading to a nozzle via a pressure chamber; an actuator unit fixed to the passage unit, the actuator unit comprising a plurality of individual electrodes related to the respective pressure chambers, a common electrode, a piezoelectric layer interposed between the plurality of individual electrodes and the common electrode, and a plurality of individual lands positioned on a bonding face of the actuator unit opposite from a fixing face of the actuator unit fixed to the passage unit, the plurality of individual lands being electrically connected to the respective individual electrodes; and a flat flexible substrate comprising a plurality of output terminals bonded to the respective individual lands, and a plurality of check terminals bonded to the bonding face of the actuator unit, the method comprising:

a measuring step of measuring an electrical characteristic with respect to the plurality of check terminals; and a judging step of deciding, on the basis of a measurement result in the measuring step, the number of check terminals having been peeled off from the bonding face of the actuator unit.

20. An inkjet recording apparatus comprising:

a passage unit in which formed are a plurality of individual ink passages each leading to a nozzle via a pressure chamber;

an actuator unit fixed to the passage unit, the actuator unit comprising a plurality of individual electrodes related to the respective pressure chambers, a common electrode, a piezoelectric layer interposed between the plurality of individual electrodes and the common electrode, and a plurality of individual lands positioned on a bonding face of the actuator unit opposite from a fixing face of the actuator unit fixed to the passage unit, the plurality of individual lands being electrically connected to the respective individual electrodes;

a flat flexible substrate comprising a plurality of output terminals bonded to the respective individual lands, and a plurality of check terminals bonded to the bonding face of the actuator unit;

a measuring unit which measures an electrical characteristic with respect to the plurality of check terminals; and a judging unit which decides, on the basis of a measurement result of the measuring unit, the number of check terminals having been peeled off from the bonding face of the actuator unit.

* * * * *